US006951195B2

(12) United States Patent
Nakano et al.

(10) Patent No.: US 6,951,195 B2
(45) Date of Patent: Oct. 4, 2005

(54) VARIABLE VALVE MECHANISM AND INTAKE AIR AMOUNT CONTROL APPARATUS OF INTERNAL COMBUSTION ENGINE

(75) Inventors: Shuuji Nakano, Nagoya (JP); Hiroyuki Kawase, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/701,616

(22) Filed: Nov. 6, 2003

(65) Prior Publication Data

US 2004/0094107 A1 May 20, 2004

(30) Foreign Application Priority Data

Nov. 18, 2002 (JP) ..... 2002-333747

(51) Int. Cl.[7] ..... F01L 1/34
(52) U.S. Cl. ..... 123/90.16; 123/90.15
(58) Field of Search ..... 123/90.15, 90.16, 123/90.17, 90.31

(56) References Cited

U.S. PATENT DOCUMENTS 4,850,311 A * 7/1989 Sohn ..... 123/90.18
5,937,806 A * 8/1999 Lyko et al. ..... 123/90.15
6,647,935 B2 * 11/2003 Aoyama et al. ..... 123/90.16

FOREIGN PATENT DOCUMENTS

JP A 5-18221 1/1993
JP A 2001-263015 9/2001

* cited by examiner

*Primary Examiner*—Thomas Denion
*Assistant Examiner*—Zelalem Eshete
(74) *Attorney, Agent, or Firm*—Kenyon & Kenyon

(57) ABSTRACT

A variable valve mechanism of an internal combustion engine capable of changing at least one of two valve physical quantities, i.e., valve operation angle and valve lift, has a valve lift adjustment mechanism that adjusts the at least one valve physical quantity with a higher precision in a region where the at least one valve physical quantity is relatively small than in a region where the at least one valve physical quantity is relatively large. Therefore, a size increase of the variable valve mechanism can be avoided, and the mechanism can easily be incorporated into the engine.

14 Claims, 28 Drawing Sheets

VARIABLE VALVE MECHANISM AND INTAKE AIR AMOUNT CONTROL APPARATUS OF INTERNAL COMBUSTION ENGINE

INCORPORATION BY REFERENCE

The disclosure of Japanese Patent Applications No. 2002-333747 filed on Nov. 18, 2002, including the specification, drawings and abstract is incorporated herein by reference in its entirety.

BACKGROUND OF THE INVENTION

1. Field of Invention

The invention relates to a variable valve mechanism of an internal combustion engine, and to an intake air amount control apparatus employing the variable valve mechanism.

2. Description of Related Art

Variable valve mechanisms for changing the operation angle and the valve lift of intake valves and exhaust valves in accordance with the state of operation of an internal combustion engine are known. Such variable valve mechanisms are disclosed in, for example, Japanese Patent Application Laid-Open Publication No. 2001-263015 (pages 9 and 10, and FIG. 21), and Japanese Patent Application Laid-Open Publication No. 5-18221 (page 4, and FIG. 2).

In a variable valve mechanism described in Japanese Patent Application Laid-Open Publication No. 2001-263015, the phase difference between an input portion and an output portion of an intervening actuation mechanism is changed by moving a control shaft in the direction of an axis, so as to adjust the starting position of valve lift caused by a cam.

In a variable valve mechanism described in Japanese Patent Application Laid-Open Publication No. 5-18221, a three-dimensional cam is moved in the direction along a shaft to change the cam profile in order to adjust the valve lift starting position.

The use of such variable valve mechanisms and three-dimensional cams for adjusting the amount of intake air supplied into an internal combustion engine instead of using, for example, a throttle valve or the like, has been considered. However, a possibility recognized in conjunction with the adjustment of the amount of intake air and the air intake timing based on the valve operation angle and the valve lift is that the adjustment via the variable valve mechanism may become less precise than the adjustment via a throttle valve depending on circumstances, and therefore may give rise to a problem in the operation control of the internal combustion engine.

The adjustment precision can be improve by, for example, reducing the rate of change of the valve operation angle or valve lift with respect to the amount of movement of the control shaft in the variable valve mechanism or reducing the rate of change of the valve operation angle or valve lift based on the change in profile of the three-dimensional cam in the direction of an axis of the cam. However, reduction of the aforementioned rate of change involves an increased range of movement of the control shaft, or a three-dimensional cam elongated in the direction of the axis. Thus, it becomes difficult to incorporate the variable valve mechanism into an internal combustion engine.

Another measure to improve the adjustment precision is adoption of a high-precision actuator for highly precise movement of the control shaft or the three-dimensional cam in the direction of the axis. However, the high-precision actuator is very likely to be large in size.

SUMMARY OF THE INVENTION

As embodiments of the invention, there are provided a variable valve mechanism of an internal combustion engine which does not produce a problem in the operation control of the engine and which can easily be incorporated into the engine, and an intake air amount control apparatus that employs the variable valve mechanism.

Specifically, the invention provides a variable valve mechanism of an internal combustion engine capable of changing at least one valve physical quantity selected from the group consisting, of a valve operation angle and a valve lift, the mechanism being characterized by including a valve lift adjustment mechanism that adjusts the at least one valve physical quantity with a higher precision in a region where the at least one valve physical quantity is relatively small than in a region where the at least one valve physical quantity is relatively large.

The present inventors have found that, in an internal combustion engine operation control based on the adjustment of at least one valve physical quantity (a physical quantity that indicates a state of actuation of a valve) selected from the group consisting of the valve operation angle and the valve lift, the valve physical quantity needs to be adjusted with high precision particularly in a region where the valve physical quantity is relatively small, and the adjustment precision needed for a large-valve physical quantity region is not so high as the adjustment precision needed for the small-valve physical quantity region.

Therefore, the valve lift adjustment mechanism designed so as to adjust the valve physical quantity with a higher precision in the small-valve physical quantity region than in the large-valve physical quantity region will reduce the range of movement of a control shaft, if a control shaft is used, to a small range. If a three-dimensional cam is employed, the variable valve mechanism will avoid a length increase of the three-dimensional cam in the direction of the axis. Therefore, the variable valve mechanism can easily be incorporated into the internal combustion engine. Similarly, if an actuator is employed, the variable valve mechanism will avoid a size increase of the actuator provided that a higher adjustment precision is achieved in the small-valve physical quantity region. Hence, the incorporation of the variable valve mechanism into the engine becomes easy. In any one of the aforementioned cases, the variable valve mechanism does not produce a problem in the operation control of the engine.

In a preferred form of the invention, an intake valve may be an object where the valve physical quantity is adjusted by the variable valve mechanism of the engine.

If an intake valve is an object where the valve physical quantity is changed, the amount of intake air can be adjusted on the basis of a valve physical quantity of the intake valve. If the amount of intake air is adjusted on the basis of the valve physical quantity of the intake valve as described above, the valve physical quantity can be adjusted with a high precision when the amount of intake air is small. Therefore, no problem is produced in the operation control of the engine. Furthermore, a size increase of the entire construction of the valve lift adjustment mechanism can be prevented, and the mechanism can easily be incorporated into the engine.

According to another aspect of the invention, an intake air amount control apparatus of an internal combustion engine which includes the above-described variable valve mechanism of the internal combustion engine as a variable valve mechanism for an intake valve, and which adjusts the amount of intake air by adjusting the valve physical quantity of the intake valve via the variable valve mechanism is provided.

If the above-described variable valve mechanism is provided as a variable valve mechanism for an intake valve, it becomes easy to incorporate the variable valve mechanism into the engine. Furthermore, the amount of intake air can be adjusted with high precision when the amount of intake air is small, and no problem will be caused in the operation control of the internal combustion engine.

BRIEF DESCRIPTION OF THE DRAWINGS

The above mentioned and other objects, features, advantages, technical and industrial significances of this invention will be better understood by reading the following detailed description of preferred embodiments of the invention, when considered in connection with the accompanying drawings, in which.

DETAILED DESCRIPTION OF PREFERRED EMBODIMENTS

In the following description and the accompanying drawings, the present invention will be described in more detail with reference to exemplary embodiments.

Figure 1:
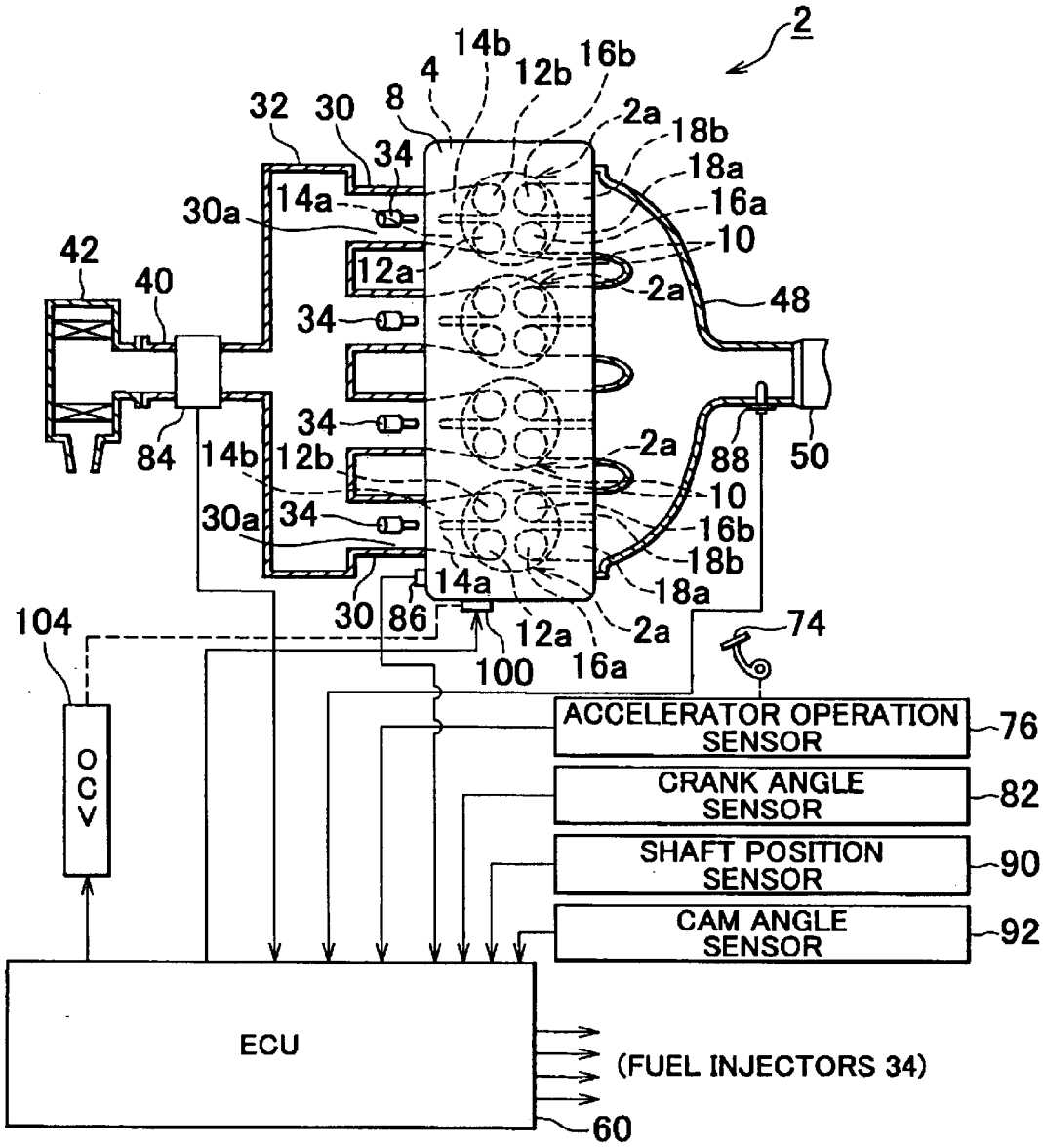
FIG. 1 is a schematic block diagram illustrating a construction of an engine and a control system of the engine in accordance with a first embodiment of the invention.
Figure 2:
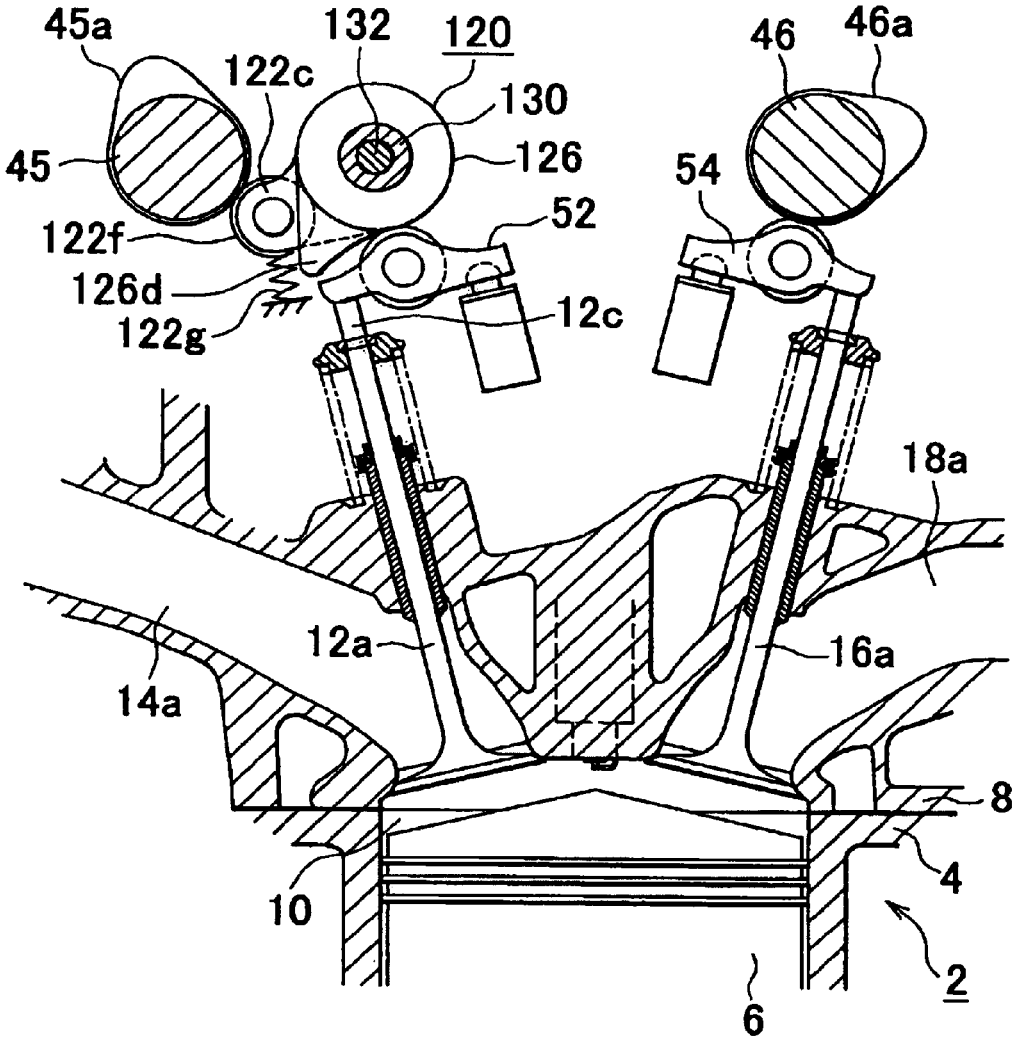
FIG. 2 is a longitudinal sectional view of the engine.
Figure 3:
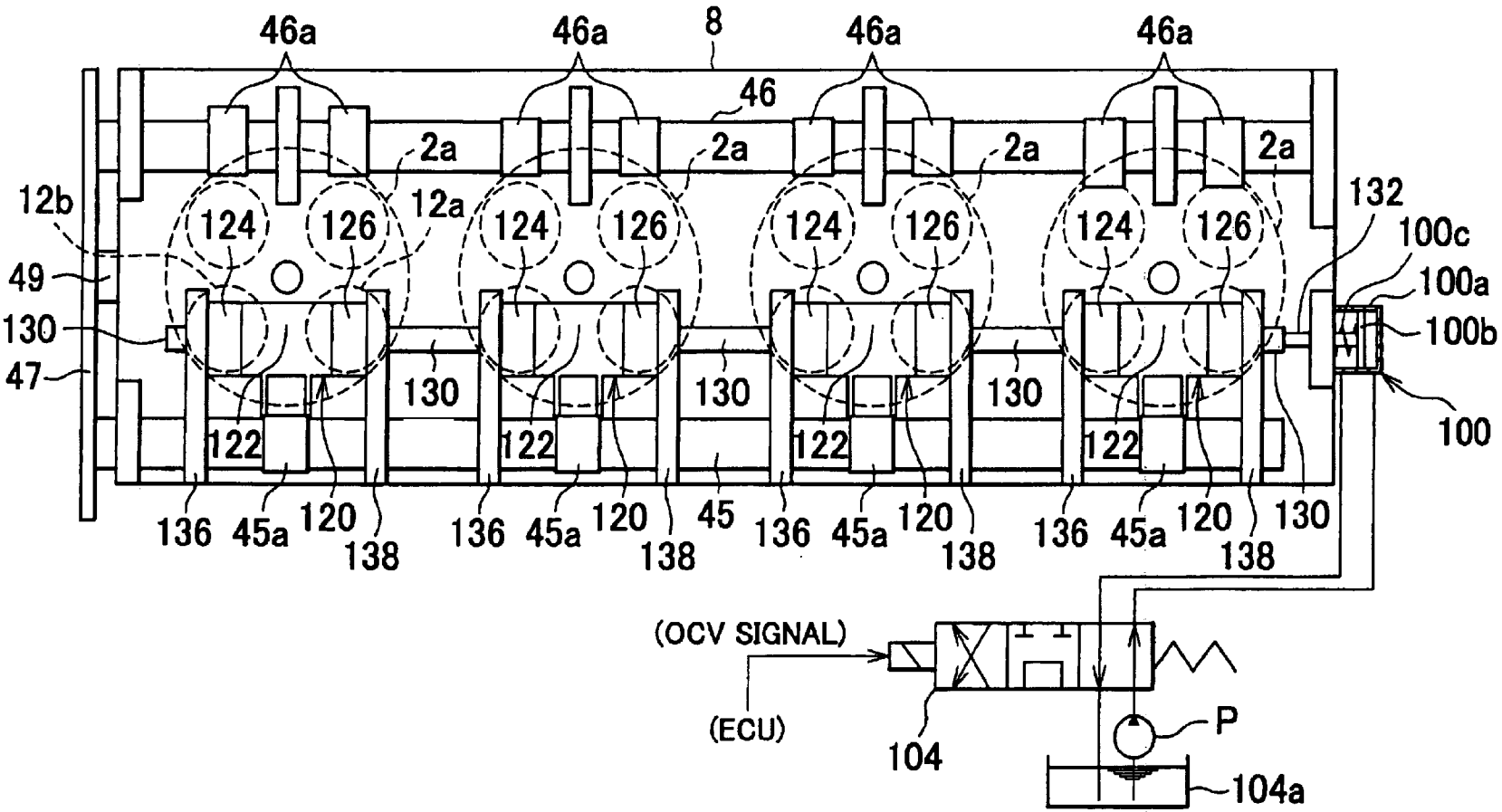
FIG. 3 is a plan view of the engine.

FIG. 1 is a schematic block diagram illustrating a gasoline engine (hereinafter, simply referred to as "engine") 2 as an internal combustion engine equipped with a variable valve mechanism to which the invention is applied, and a control system of the engine 2. FIG. 2 is a longitudinal sectional view of a cylinder. FIG. 3 is a plan view of an upper portion of the engine 2.

The engine 2 is installed in a motor vehicle. The engine 2 includes a cylinder block 4, pistons 6, a cylinder head 8 attached to an upper portion of the cylinder block 4, etc. The cylinder block 4 has a plurality of cylinders, for example, four cylinders 2*a* in this embodiment. Each cylinder 2*a* has a combustion chamber 10 that is defined by the cylinder block 4, the piston 6 and the cylinder head 8. Each cylinder 2*a* is provided with four valves, that is, a first intake valve 12*a*, a second intake valve 12*b*, a first exhaust valve 16*a*, and a second exhaust valve 16*b*. The first intake valve 12*a* and the second intake valve 12*b* open and close a first intake port 14*a* and a second intake port 14*b*, respectively. The first exhaust valve 16*a* and the second exhaust valve 16*b* open and close a first exhaust port 18*a* and a second exhaust port 18*b*, respectively.

The first and second ports 14*a*, 14*b* of the cylinders 2*a* are connected to a surge tank 32 via intake passageways 30*a* formed in an intake manifold 30. Each intake passageway 30*a* is provided with a fuel injector 34 so that fuel can be injected into the first intake port 14*a* and the second intake port 14*b* of a corresponding one of the cylinders.

The surge tank 32 is connected to an air cleaner 42 via an intake duct 40. Although in the construction of the embodiment, a throttle valve is not disposed in the intake duct 40, it is possible to dispose an auxiliary throttle valve in the intake duct 40. If an auxiliary throttle valve is provided, it is possible to perform a control of fully opening the throttle valve at the time of startup of the engine 2 and completely closing the throttle valve at the time of stop of the engine 2 and perform a control of adjusting the amount of intake air through the throttle valve opening control in the case of an abnormality of an intervening actuation mechanism.

A control of the amount of intake air in accordance with the operation of an accelerator pedal 74 and a control of the amount of intake air in accordance with the engine rotation speed NE are performed by adjusting the valve operation angles of the first intake valve 12*a* and the second intake valve 12*b*. Although the valve lift is also adjusted in the embodiment, the valve lift adjustment will be described below as a mode of the adjustment of valve operation angle.

The lifting actuation of the two intake valves 12*a*, 12*b* is achieved by the lifting movements of an intake cam 45*a* provided on an intake camshaft 45 which are transferred via below-described roller rocker arms 52 and a below-described intervening actuation mechanism 120 disposed on the cylinder head 8 as shown in FIGS. 2 and 3. The state of transfer of lifting movements via the intervening actuation mechanism 120 is adjusted by the function of a slide actuator 100 described below, so as to adjust the valve operation angle. The intake camshaft 45 is connected to a crankshaft 49 of the engine 2 via a timing chain 47 and a timing sprocket (that may be replaced by a timing gear or a timing pulley) provided at an end of the intake camshaft 45, so that the intake camshaft 45 rotates in association with the rotation of the crankshaft 49.

The two exhaust valves 16*a*, 16*b* of each cylinder 2*a* shown in FIG. 1 are opened and closed with a predetermined valve operation angle and a predetermined valve lift by their respective exhaust cams 46*a* provided on an exhaust camshaft 46 that is rotated in association with the rotation of the engine 2, via roller rocker arms 54. The first exhaust port 18*a* and the second exhaust port 18*b* of each cylinder 2*a* are connected to an exhaust manifold 48, so that exhaust gas is let out via a catalytic converter 50.

An electronic control unit (hereinafter, referred to as "ECU") 60 is formed by a digital computer that includes a CPU, a ROM, a RAM, various driver circuits, input ports, output ports, etc., that are interconnected by a bidirectional bus.

The following signals are input to the input ports of the ECU 60. That is, an output voltage from an accelerator operation amount sensor 76 proportional to the amount of depression of the accelerator pedal 74 (hereinafter, referred to as "amount of accelerator operation ACCP") is input. Furthermore, a pulse output by a crank angle sensor at every predetermined rotation angle of the crankshaft and an output voltage from an intake air amount sensor 84 corresponding to the amount of intake air GA that flows in the intake duct 40 are input. An output voltage that is output by a water temperature sensor 86 provided in a cylinder block 4 of the engine 2 and that corresponds to the temperature of cooling water THW of the engine 2, and an output voltage that is output by an air-fuel ratio sensor 88 provided in the exhaust manifold 48 and that corresponds to the air-fuel ratio are input. An output voltage that is output by a shaft position sensor 90 provided for detecting the axial displacement of a below-described control shaft 132 moved by the slide actuator 100 and that corresponds to the displacement of the control shaft 132 in the direction of an axis of the control shaft 132 is input. An output pulse from a cam angle sensor 92 that detects the cam angle of the intake cams 45*a* that actuate the intake valves 12*a*, 12*b* via the intervening actuation mechanism 120 is input. The ECU 60 calculates the present crank angle based on the output pulse from the crank angle sensor 82 and the pulse from the cam angle sensor 92, and calculates the engine rotation speed NE based on the frequency of output pulses from the crank angle sensor 82. In addition to these signals, various other signals are input to the input ports of the ECU 60.

Output ports of the ECU 60 are connected to fuel injectors 34 via corresponding drive circuits. The ECU 60 performs a control of opening the fuel injectors 34 in accordance with the state of operation of the engine 2, and executes a fuel injection timing control and a fuel injection amount control. Furthermore, an output port of the ECU 60 is connected to an oil control valve (hereinafter, simply referred to as "OCV") 104 via a drive circuit. The ECU 60 controls the actuation of the slide actuator 100 through a hydraulic control performed by the OCV 104 in accordance with the operation of the accelerator pedal 74 and the state of operation of the engine 2. As shown in FIG. 3, the slide actuator 100 is formed by a combination of a cylinder 100*a*, a piston 100*b* and a spring 100*c*. An end of the control shaft 132 is connected to the piston 100*b*. Therefore, the control shaft 132 is actuated in the direction of the axis by the OCV 104 supplying a hydraulic fluid to or discharging the hydraulic fluid from each of the two oil pressure chambers formed on opposite sides of the piston 100*b* within the cylinder 100*a*. The spring 100*c* urges the control shaft 132 toward the right side in FIG. 3, via the piston 100*b*. This arrangement counters the axial force that is produced on the control shaft 132 at least at the time of startup of the engine 2 in such a direction as to reduce the valve operation angle (the leftward direction in FIG. 3). Therefore, the arrangement prevents the control shaft 132 from moving in the leftward direction at the time of startup of the engine 2. Thus, the arrangement performs the function of securing a necessary amount of air for each cylinder 2*a* at the time of startup of the engine 2, at which the hydraulic fluid pressure on the slide actuator 100 is insufficient.

The OCV 104 is an electromagnetic solenoid type 4-port-3-position changeover valve. During a demagnetized state (i.e., the state indicated in FIG. 3) of the electromagnetic solenoid (hereinafter, referred to as "low-lift actuation state"), the OCV 104 is supplied with high-pressure hydraulic fluid from an oil pump P so as to move the control shaft 132 in the leftward direction in FIG. 3, in which direction the amount of actuation decreases. As a result, the intervening actuation mechanism 120 is adjusted so as to reduce the operation angle of the intake valves 12*a*, 12*b* and therefore reduce the amount of intake air.

During a state of 100% magnetization of the electromagnetic solenoid (hereinafter, referred to as "high-lift actuation state"), the OCV 104 is supplied with high-pressure hydraulic fluid from the oil pump P so as to move the control shaft 132 in the rightward direction in FIG. 3, in which direction the amount of actuation increases. As a result, the intervening actuation mechanism 120 is adjusted so as to increase the operation angle of the intake valves 12*a*, 12*b* and therefore increase the amount of intake air.

If the electrification of the electromagnetic solenoid is controlled to an intermediate state (hereinafter, referred to as "neutral state"), the supply and discharge of the hydraulic fluid with respect to the oil pressure chambers stops, and the oil pressure chambers are tightly closed. As a result, the movement of the control shaft 132 in the direction of the axis stops, so that the valve operation angle of the intake valves 12*a*, 12*b* is maintained.

Figure 4:
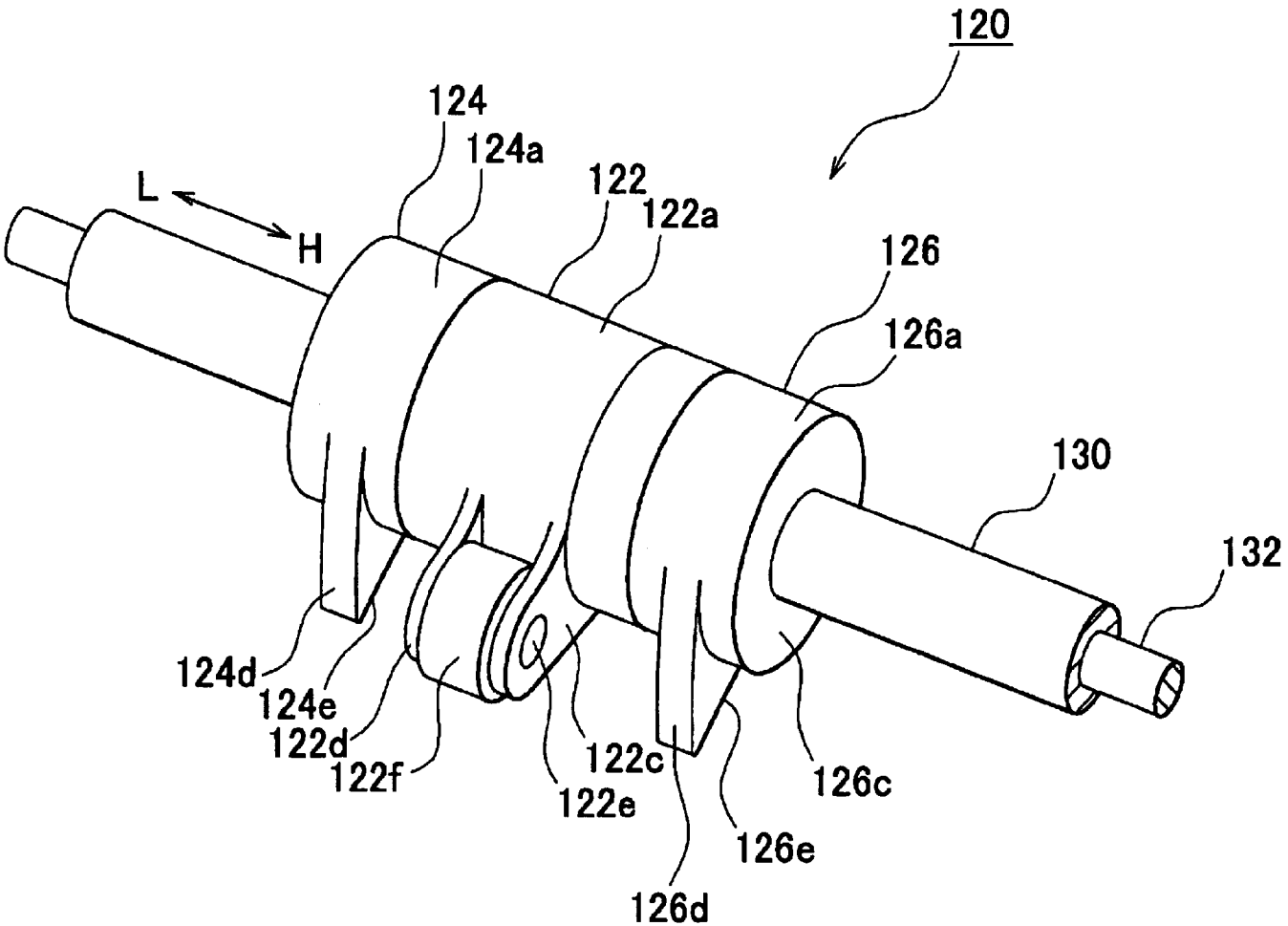
FIG. 4 is a perspective view of an intervening actuation mechanism in the first embodiment.

The intervening actuation mechanism 120 will be described. FIG. 4 shows a perspective view of the intervening actuation mechanism 120. The intervening actuation mechanism 120 includes an input section 122 shown at a center of the drawing, a first oscillating cam 124 provided on a left side of the input part 122 in FIG. 3, and a second oscillating cam 126 provided on a right side of the input section 122 in FIG. 3. A housing 122*a* of the input section 122 and housings 124*a*, 126*a* of the oscillating cams 124, 126 have cylindrical shapes with equal outside diameters.

Figure 5:
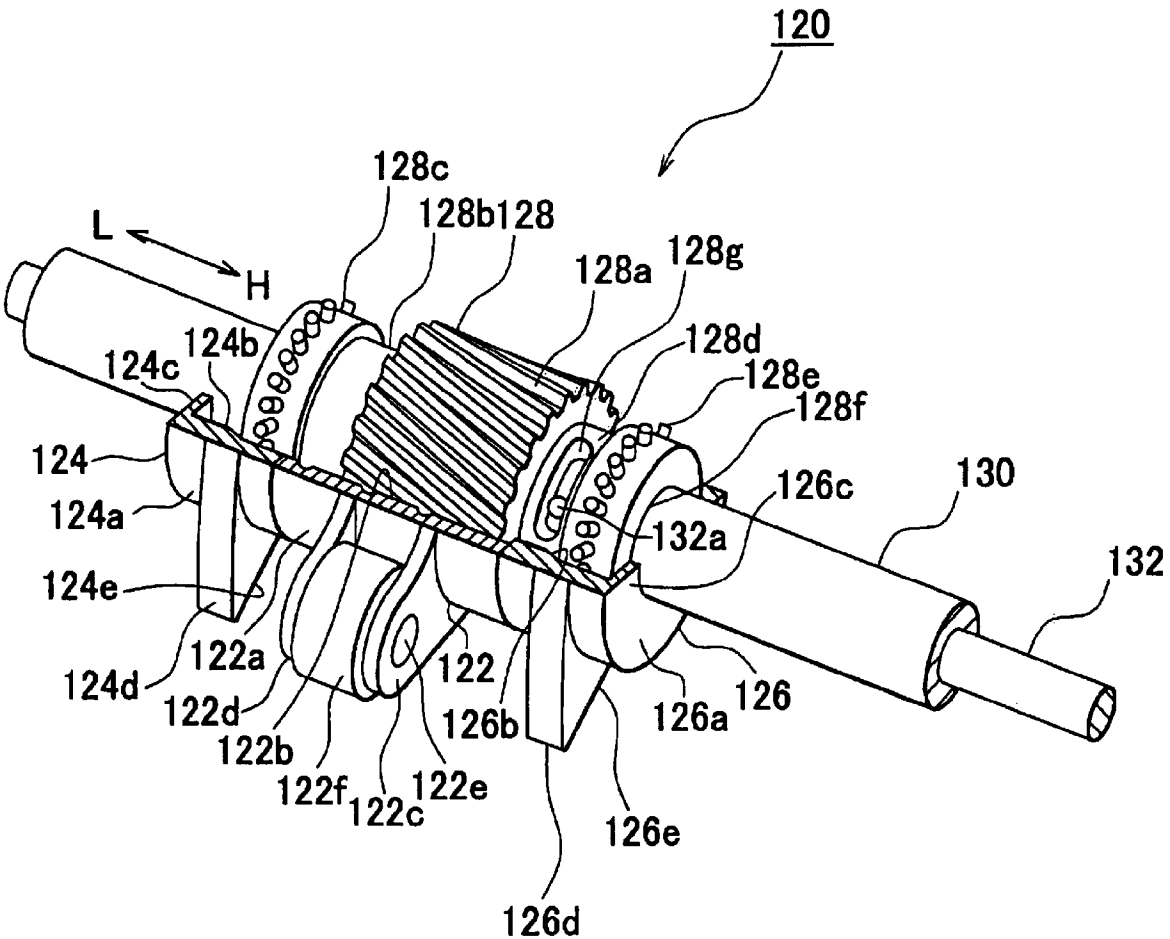
FIG. 5 is a cutaway perspective view of the intervening actuation mechanism.

FIG. 5 shows a perspective view of the intervening actuation mechanism 120 in which the housings 122*a*, 124*a*, 126*a* are horizontally cut away.

The housing 122*a* of the input section 122 has an internal space that extends in the direction of an axis. An inner peripheral surface of the housing 122*a* has helical splines 122*b* that are formed in a right-handed screw fashion about the axis. Two arms 122*c*, 122*d* extend out in parallel from an outer peripheral surface of the housing 122*a*. Distal end portions of the arms 122*c*, 122*d* support a shaft 122*e* therebetween which extends in parallel to the axis of the housing 122*a*. A roller 122*f* is rotatably provided on the shaft 122*e*. As shown in FIG. 2, the roller 122*f* is urged by a spring 122*g* so as to always remain in contact with the intake cam 45*a*.

Figure 6:
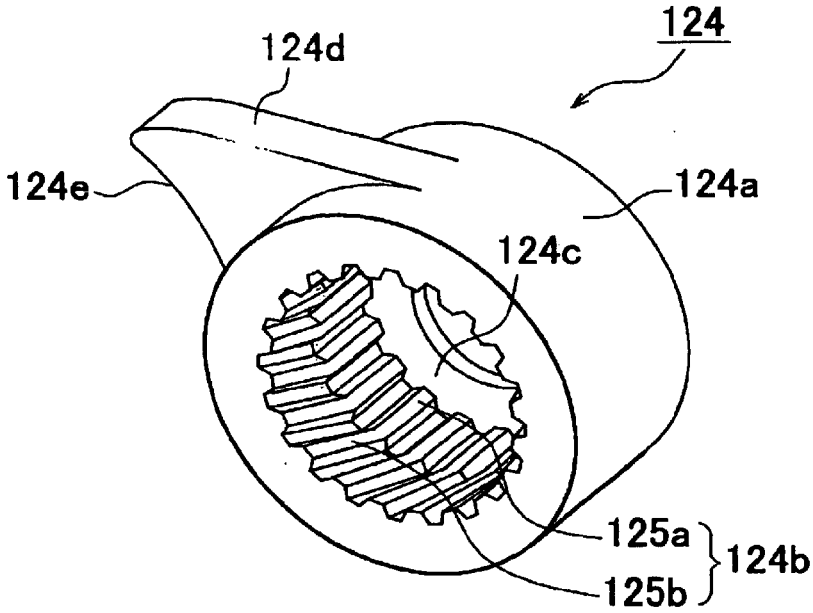
FIG. 6 is a perspective view of a first oscillating cam in the first embodiment.

The housing 124*a* of the first oscillating cam 124 has an internal space that extends in the direction of the axis. An inner peripheral surface of the housing 124*a* has helical splines 124*b* that are formed in a left-handed screw fashion about the axis. As shown in the perspective view of FIG. 6, the angle of inclination of the helical splines 124*b* changes at a central position in the direction of the axis. Thus, the set of helical splines 124*b* is divided into a small-operation angle helical spline set 125*a* having a small angle of inclination and a large-operation angle helical spline set 125*b* having a large angle of inclination. A left side end of the internal space of the housing 124*a* is partially closed by a ring-shaped bearing portion 124*c* that has a small-diameter central hole. A generally triangular nose 124*d* is protruded from the outer peripheral surface of the housing 124*a*. A side surface of the generally triangular nose 124*d* forms a concavely curved cam surface 124*e*.

Figure 7:
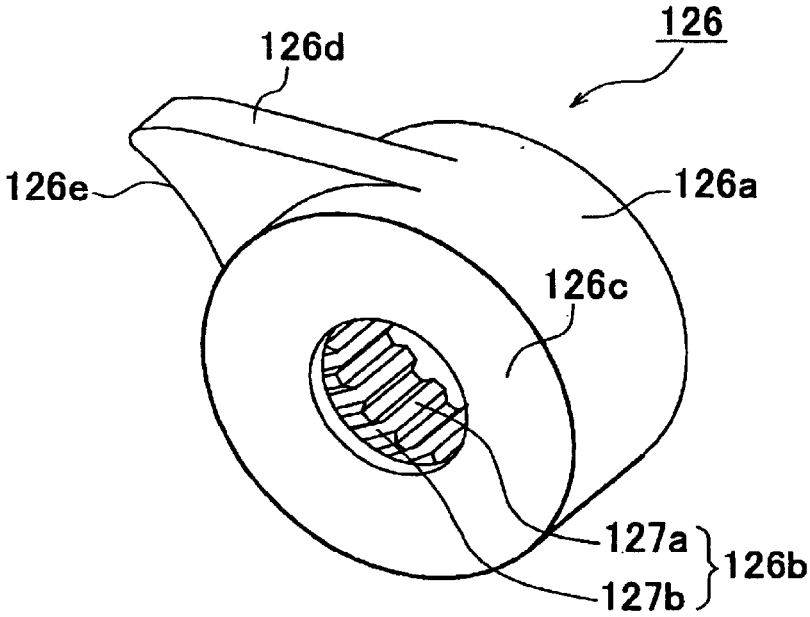
FIG. 7 is a perspective view of a second oscillating cam in the first embodiment.

The housing 126*a* of the second oscillating cam 126 has an internal space that extends in the direction of the axis. An inner peripheral surface of the housing 126*a* has helical splines 126*b* that are formed in a left-handed screw fashion about the axis. As shown in the perspective view of FIG. 7, the angle of inclination of the helical splines 126*b* changes at an intermediate position in the direction of the axis. Thus, the set of helical splines 126*b* is divided into a small-operation angle helical spline set 127*a* having a small angle of inclination and a large-operation angle helical spline set 127*b* having a large angle of inclination. A right side end of the internal space of the housing 126*a* is partially closed by a ring-shaped bearing portion 126*c* that has a small-diameter central hole. A generally triangular nose 126*d* is protruded from the outer peripheral surface of the housing 126*a*. A side surface of the generally triangular nose 126*d* forms a concavely curved cam surface 126*e*.

The first oscillating cam 124 and the second oscillating cam 126 are coaxially disposed so that end surfaces thereof contact two opposite sides of the input section 122 with the bearing portions 124*c*, 126*c* facing outwards. Thus, the first oscillating cam 124, the second oscillating cam 126 and the input section 122 together form a generally cylindrical shape having an internal space, as shown in FIG. 4.

Figure 8:
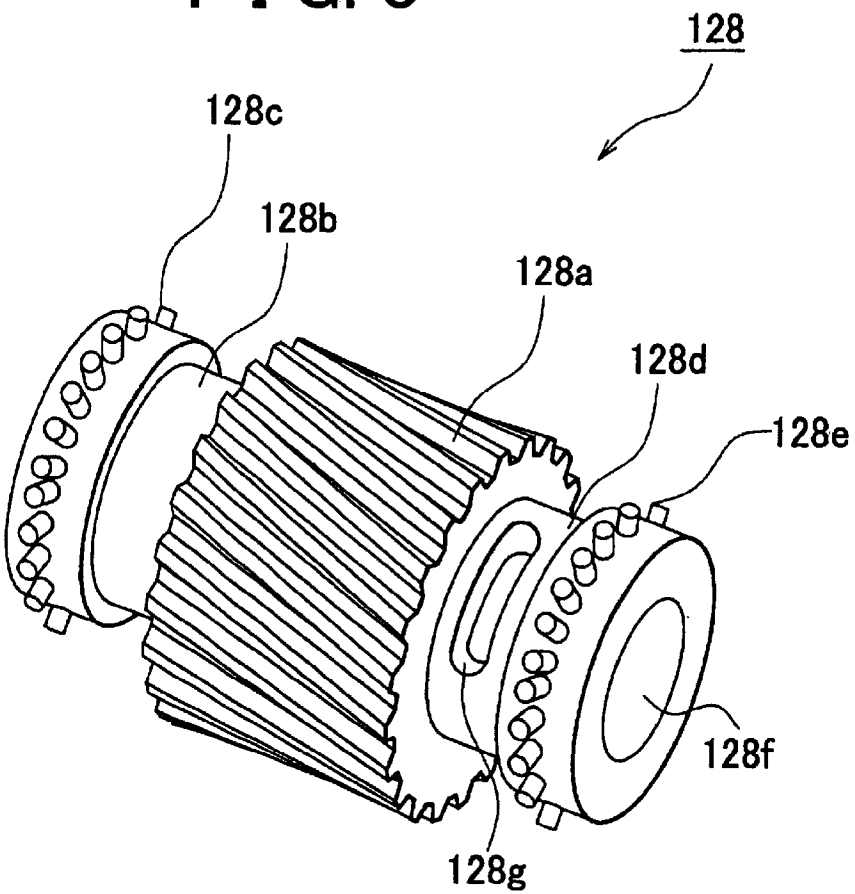
FIG. 8 is a perspective view of a slider gear in the first embodiment.
Figure 9A:
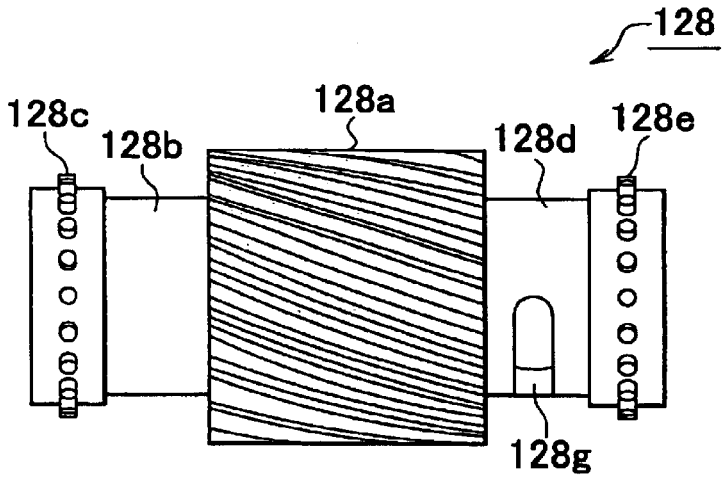
FIGS. 9A to 9C illustrate the construction of the slider gear.
Figure 9B:
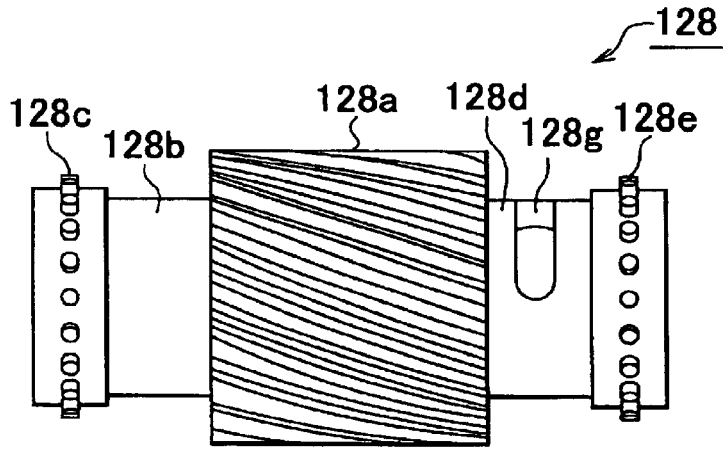
Figure 9C:
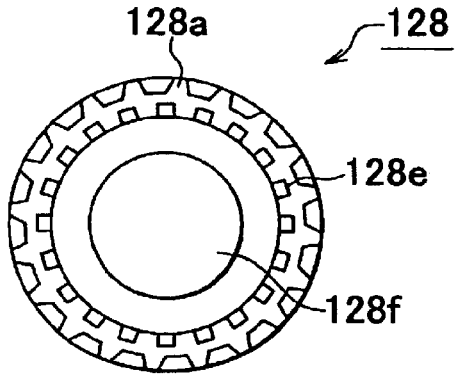

A slider gear 128 is disposed in an internal space defined by the input section 122 and the two oscillating cams 124, 126. The construction of the slider gear 128 is illustrated in the perspective view of FIG. 8, the plan view of FIG. 9A, the front view of FIG. 9B, and the right-side view of FIG. 9C. The slider gear 128 has a generally cylindrical shape. A central portion of the outer peripheral surface of the slider gear 128 has input helical splines 128*a* that are formed in a right-handed screw fashion. A first array of pins 128*c* arranged in a circumferential direction is provided in a left side end portion of the slider gear 128. A small-diameter portion 128*b* is provided between the first array of pins 128*c* and the left side end of the input helical spline set 128*a*. A second array of pins 128*e* arranged in a circumferential direction is provided in a right side end portion of the slider gear 128. A small-diameter portion 128*d* is provided between the second array of pins 128*e* and the right side end of the input helical spline set 128*a*. The diameter of imaginary circles defined by the distal ends of the pins 128*c*, 128*e* is smaller than the core diameter of the input helical spline set 128*a*.

The slider gear 128 has an internal through-hole 128*f* that extends in the direction of a center axis of the slider gear 128. The small-diameter portion 128*d* has an elongated hole 128*g* for communication between the internal through-hole 128*f* and the outer surface of the slider gear 128. The elongated hole 128*g* is long in the circumferential direction.

Figure 10A:
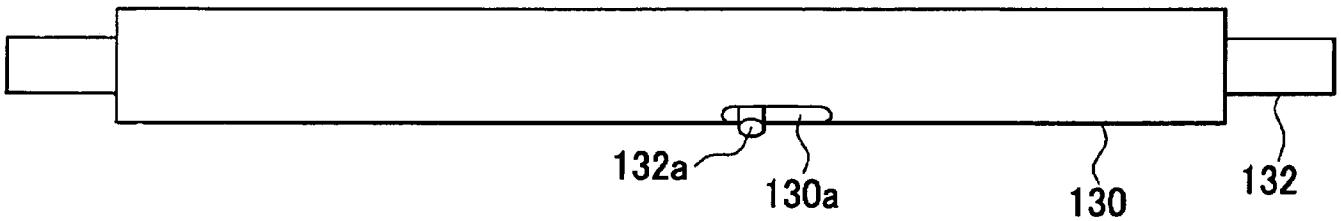
FIGS. 10A to 10C illustrate the construction of a support pipe and a control shaft in the first embodiment.
Figure 10B:
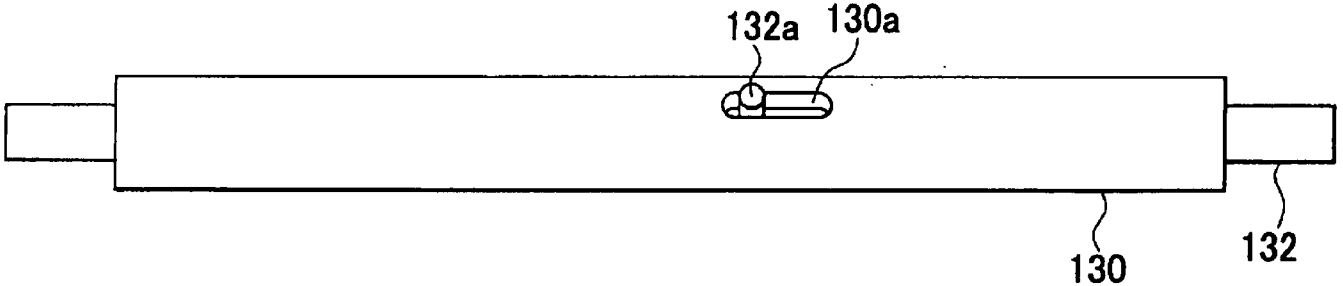
Figure 10C:
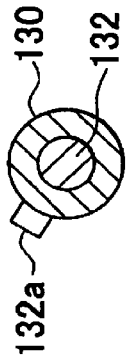

A support pipe 130 as shown in FIGS. 10A to 10C extends through the through-hole 128*f* of the slider gear 128 so as to be slidable in the circumferential direction. FIGS. 10A, 10B and 10C are a plan view, a front view, and a right side view of the support pipe 130, respectively. The support pipe 130 is provided as a common support pipe that extends through all the intervening actuation mechanisms 120 (four mechanisms in this embodiment) as shown in FIG. 3. The support pipe 130 has an elongated hole 130*a* that is opened for each intervening actuation mechanism 120. The elongated holes 130*a* are long in the direction of the axis.

As shown in FIGS. 10A to 10C, the control shaft 132 extends through the internal space of the support pipe 130 so as to be slidable in the direction of the axis. As is the case with the support pipe 130, the control shaft 132 is provided as a common shaft for all the intervening actuation mechanisms 120. The control shaft 132 has a protruded stopper pin 132*a* for each intervening actuation mechanism 120. The stopper pins 132*a* extend through the corresponding elongated holes 130*a* of the support pipe 130. A distal end of each stopper pin 132*a* is inserted in the circumferentially elongated hole 128*g* of a corresponding one of the slider gears 128.

The following description will be made with respect to one slider gear 128. Due to the axially elongated hole 130*a* formed in the support pipe 130, the stopper pin 132*a* of the control shaft 132 is able to move the slider gear 128 in the direction of the axis, along with movement of the control shaft 132 in the direction of the axis, although the support pipe 130 is fixed to the cylinder head 8. Furthermore, since the circumferentially elongated hole 128*g* of the slider gear 128 is engaged with the stopper pin 132*a*, the slider gear 128 is pivotable about its axis while the position of the slider gear 128 in the direction of the axis is determined by the stopper pin 132*a*.

Figure 11:
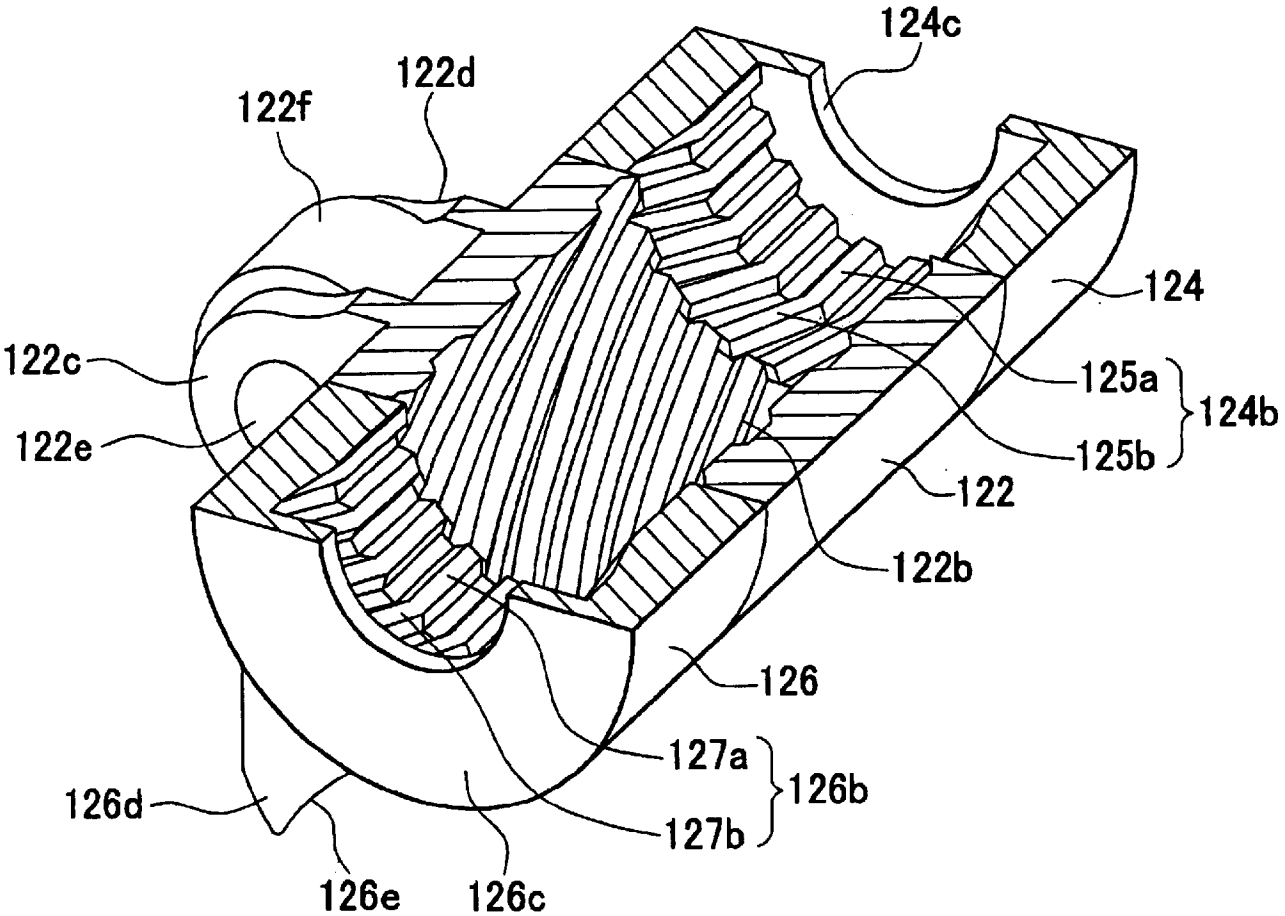
FIG. 11 is a cutaway perspective view of an input section and oscillating cams in the first embodiment.
Figure 12:
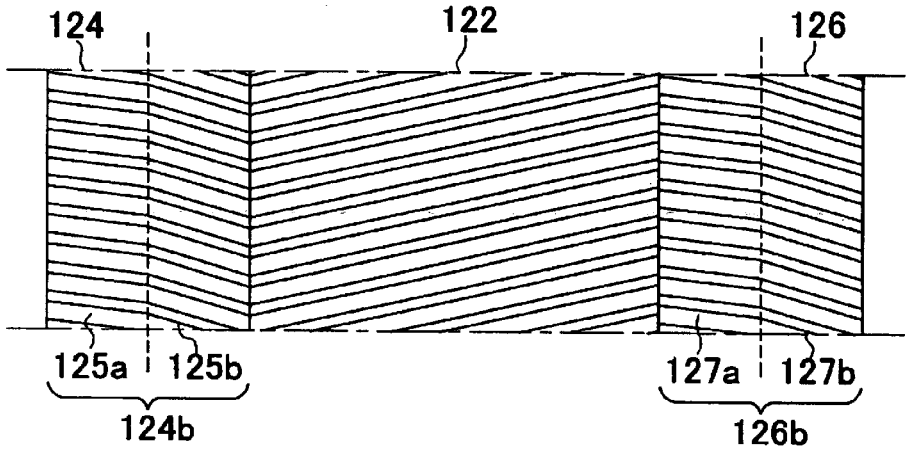
FIG. 12 is a developed view of helical splines of the input section and the oscillating cams in the first embodiment.

The slider gear 128 is disposed in the internal space of the input section 122 and the oscillating cams 124, 126 assembled as shown in the cutaway perspective view of FIG. 11. The input helical spline set 128*a* of the slider gear 128 meshes with the internal helical spline set 122*b* of the input section 122. The first array of pins 128*c* meshes with the internal helical spline set 124*b* of the first oscillating cam 124. The second array of pins 128*e* meshes with the internal helical spline set 126*b* of the second oscillating cam 126. FIG. 12 is a two-dimensionally developed view of portions of the internal helical spline sets 122*b*, 124*b*, 126*b* of the input section 122 and the oscillating cams 124, 126.

Each intervening actuation mechanism 120 constructed as described above is sandwiched between standing walls 136, 138 formed on the cylinder head 8 as shown in FIG. 3 so that the intervening actuation mechanism 120 is pivotable about the axis, but is prevented from moving in the direction of the axis. The standing walls 136, 138 contact the bearing portion sides of the oscillating cams 124, 126. The standing walls 136, 138 have a hole at a position corresponding to the central holes of the bearing portions 124*c*, 126*c*. The support pipe 130 extends through and is fixed to the holes of the standing walls 136, 138. Therefore, the support pipe 130 is fixed in position with respect to the cylinder head 8, and cannot be moved in the direction of the axis or rotated.

Figure 13:
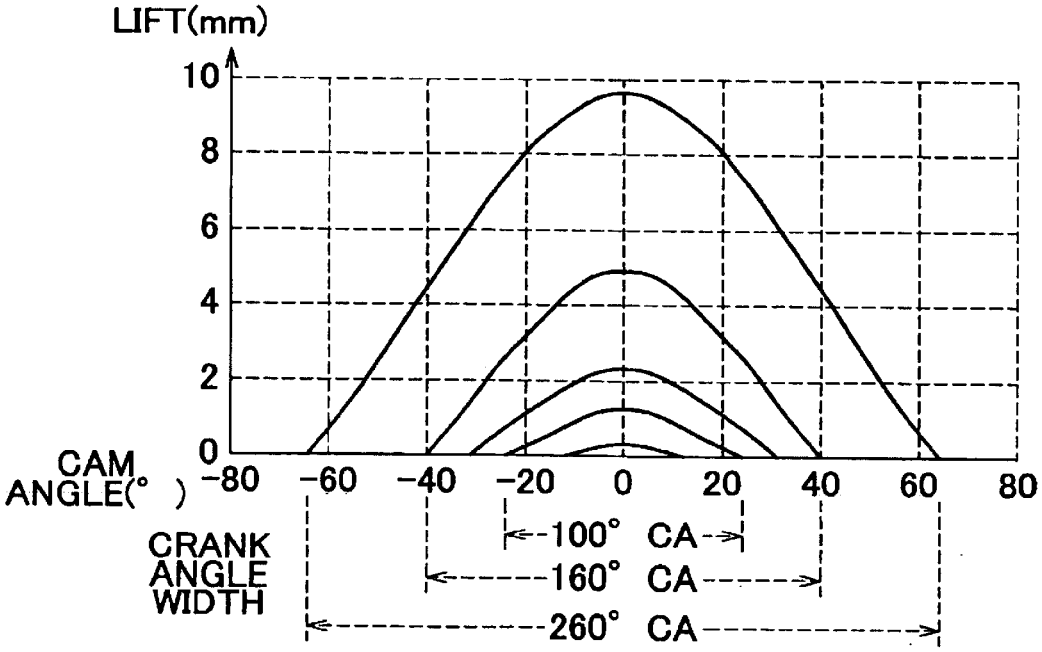
FIG. 13 is a diagram indicating changes in the valve operation angle in the first embodiment.

The control shaft 132 extends through the internal space of the support pipe 130 so as to be slidable in the direction of the axis, and is connected at an end thereof to a piston 100*b* of the slide actuator 100. Therefore, the position of the control shaft 132 in the direction of the axis can be adjusted through the operating oil pressure control performed by the OCV 104. Hence, the relative phase difference between the roller 122*f* of the input section 122 and the noses 124*d*, 126*d* of the oscillating cams 124, 126 can be adjusted via the control shaft 132 and the slider gear 128. That is, as indicated in FIG. 13, the valve operation angle of the intake valves 12*a*, 12*b* can be continuously adjusted as represented by crank angle widths by continuously changing the valve lift of the intake valves 12*a*, 12*b* through the actuation of the slide actuator 100.

Figure 14B:
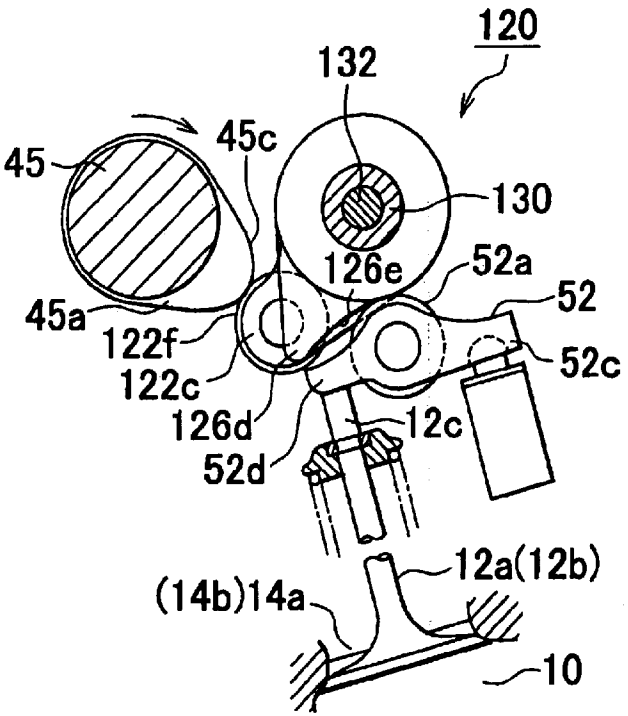
FIGS. 14A and 14B illustrate the function of the intervening actuation mechanism in the first embodiment.
Figure 14A:
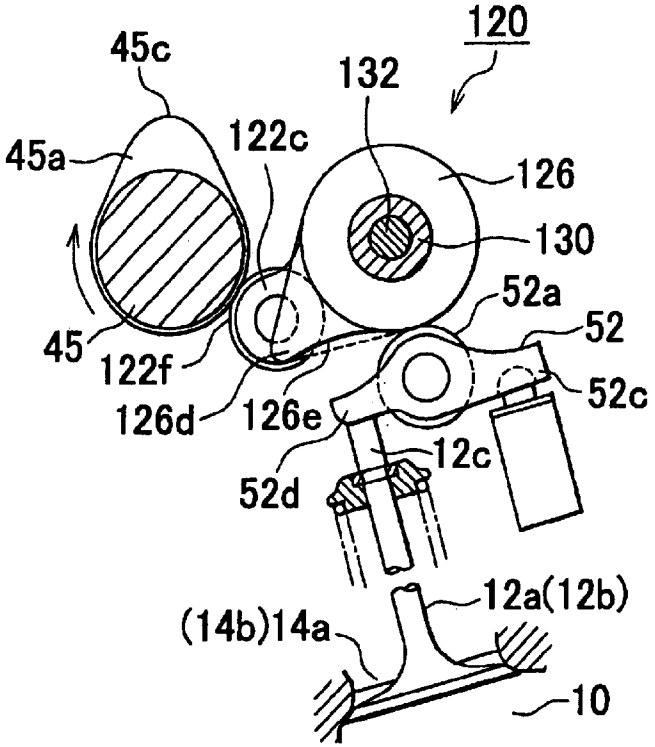

FIGS. 14A and 14B illustrate states of an intervening actuation mechanism 120 in a case where the control shaft 132 has been moved to a maximum limit in the direction L, that is, where the amount of slide=0 (mm). In this case, the first array of pins 128*c* of the slider gear 128 is in mesh with the small-operation angle helical spline set 125*a* of the first oscillating cam 124 shown in FIGS. 11 and 12. The second array of pins 128*e* of the slider gear 128 is in mesh with the small-operation angle helical spline set 127*a* of the second oscillating cam 126 shown in FIGS. 11 and 12. A relationship between of the slider gear 128 and the oscillating cams 124, 126 in the aforementioned case is indicated in the perspective view of FIG. 15.

During the state illustrated in FIG. 14A, a roller 52*a* of a roller rocker arm 52 is in contact with a base circle portion (i.e., a portion that excludes the nose 124*d*, 126*d*) of the oscillating cam 124 that is greatly apart from the nose 124*d*, 126*d*. Therefore, during the entire period of oscillation, the roller 52*a* of the roller rocker arm 52 remains in contact with the base circle portion of the oscillating cam without contacting the curved cam surface 124*e*, 126*e* of the nose 124*d*, 126*d*. That is, the curved cam surface 124*e*, 126*e* of the nose 124*d*, 126*d* does not push the roller 52*a* of the roller rocker arm 52 down even when a nose of the intake cam 45*a* pushes the roller 122*f* of the input section 122 down to a maximum limit as shown in FIG. 14B. Therefore, the roller rocker arm 52 does not oscillate about a base end portion 52*c*, and a distal end portion 52*d* of the roller rocker arm 52 does not push a stem end 12*c* down, so that the valve operation angle is "0". Thus, the intake valves 12*a*, 12*b* maintain the closed state of the intake ports 14*a*, 14*b* despite rotation of the intake camshaft 45.

Figure 15:
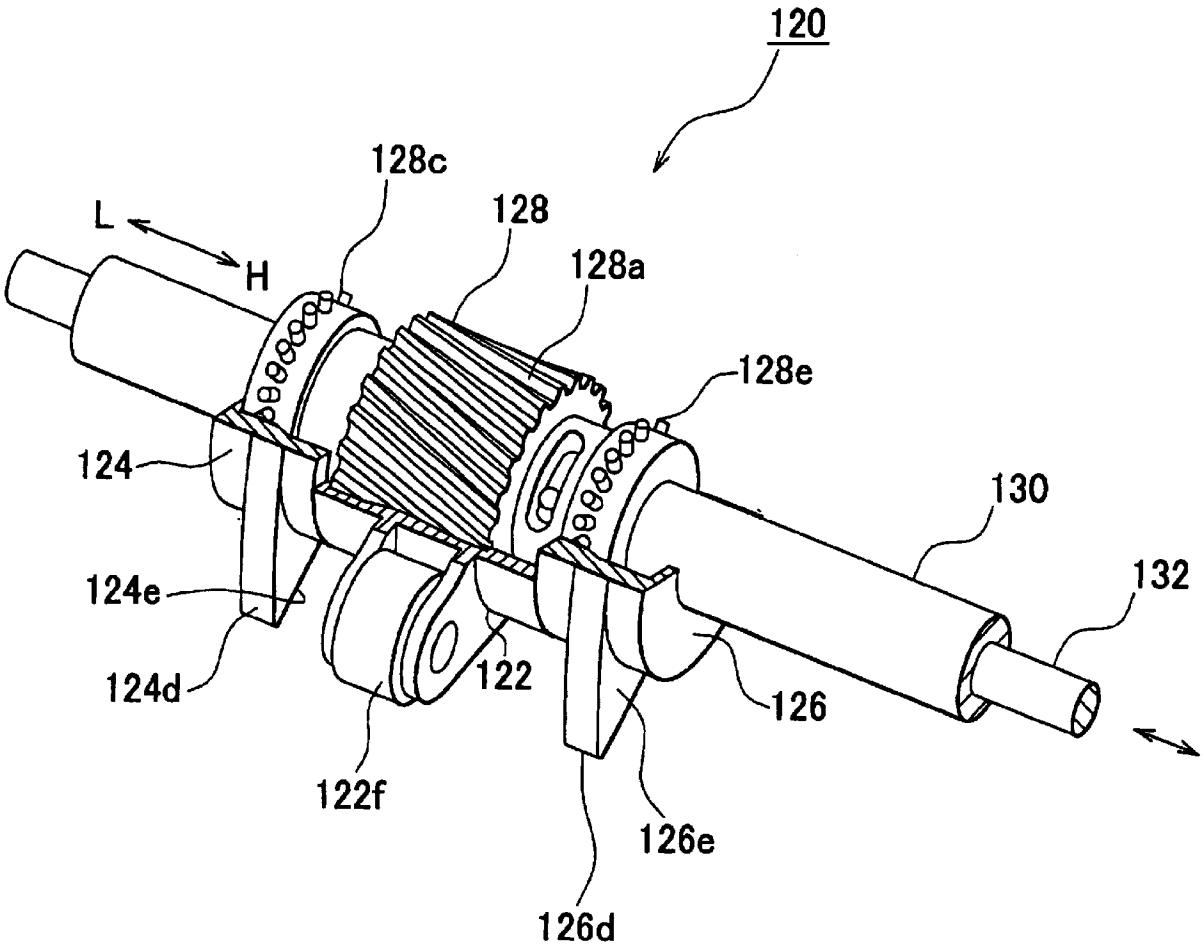
FIG. 15 illustrates the function of the intervening actuation mechanism in the first embodiment.
Figure 16A:
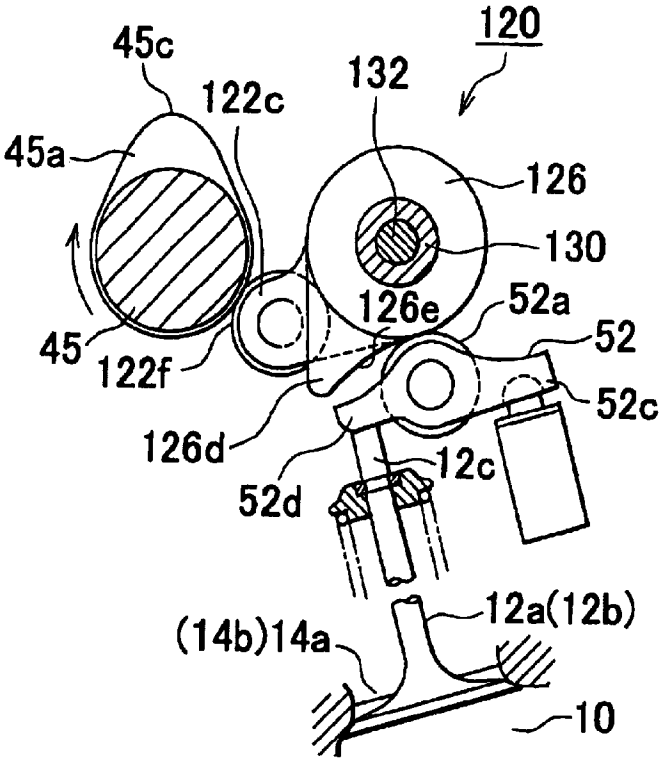
FIGS. 16A and 16B illustrate the function of the intervening actuation mechanism in the first embodiment.
Figure 16B:
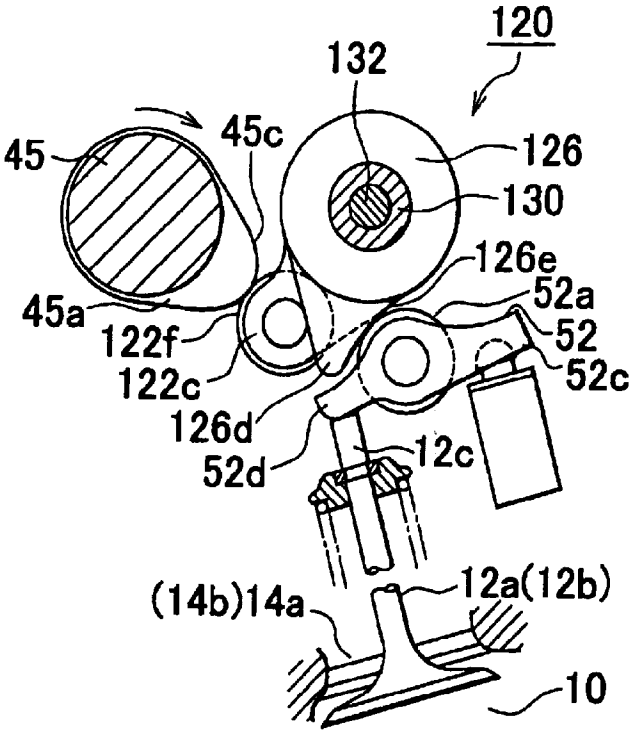

FIGS. 16A and 16B illustrate states of the intervening actuation mechanism 120 in a case where the control shaft 132 has been moved in the direction H from the state shown in FIG. 15 to the position of an intermediate amount of slide. In this case, the first array of pins 128*c* of the slider gear 128 is positioned at a boundary between the small-operation angle helical spline set 125*a* and the large-operation angle helical spline set 125*b* of the first oscillating cam 124. The second array of pins 128*e* of the slider gear 128 is positioned at a boundary between the small-operation angle helical spline set 127*a* and the large-operation angle helical spline set 127*b* of the second oscillating cam 126. Thus, the oscillating cams 124, 126 have been pivoted from the state shown in FIGS. 14A and 14B, via the small-operation angle helical spline sets 125*a*, 127*a*.

In FIG. 16A, the base circle portion of the intake cam 45*a* contacts the roller 122*f* of the input section 122 of the intervening actuation mechanism 120. During this state, the nose 124*d*, 126*d* of each oscillating cam 124, 126 is not in contact with the roller 52*a* of the roller rocker arm 52, and a base circle portion of each oscillating cam that contacts the roller 52*a* is slightly closer to the nose 124*d*, 126*d* than during the state illustrated in FIGS. 14A and 14B. This is attributed to a movement of the slider gear 128 in the direction H within the intervening actuation mechanism 120 which results in an increased relative phase difference between the roller 122*f* of the input section 122 and the noses 124*d*, 126*d* of the oscillating cams 124, 126.

If the intake camshaft 45 rotates and the nose 45*c* of the intake cam 45*a* pushes the roller 122*f* of the input section 122 down while the increased relative phase difference is maintained, the pivoting movement of the input section 122 is transferred to the oscillating cams 124, 126 via the slider gear 128, so that the noses 124*d*, 126*d* pivot.

As stated above, during the state illustrated in FIG. 16A, the base circle portions of the noses 124*d*, 126*d* apart from the noses 124*d*, 126*d* contact the rollers 52*a* of the roller rocker arms 52. Therefore, for some time after the oscillating cams 124, 126 start to pivot, the rollers 52*a* of the roller rocker arms 52 remain in contact with the base circle portions without contacting the curved cam surfaces 124*e* of the noses 124*d*, 126*d*. After that, the curved cam surfaces 124*e* come into contact with the rollers 52*a*, and push the rollers 52*a* of the roller rocker arms 52 as shown in FIG. 16B. Therefore, the roller rocker arms 52 pivot about their base end portions 52*c*. In this manner, the distal end portion 52*d* of each roller rocker arm 52 pushes the stem end 12*c*, thereby producing a valve operation angle. Thus, the intake valves 12*a*, 12*b* achieve an open state of the intake ports 14*a*, 14*b* with a valve operation angle that is slightly smaller than an intermediate valve angle.

Figure 17A:
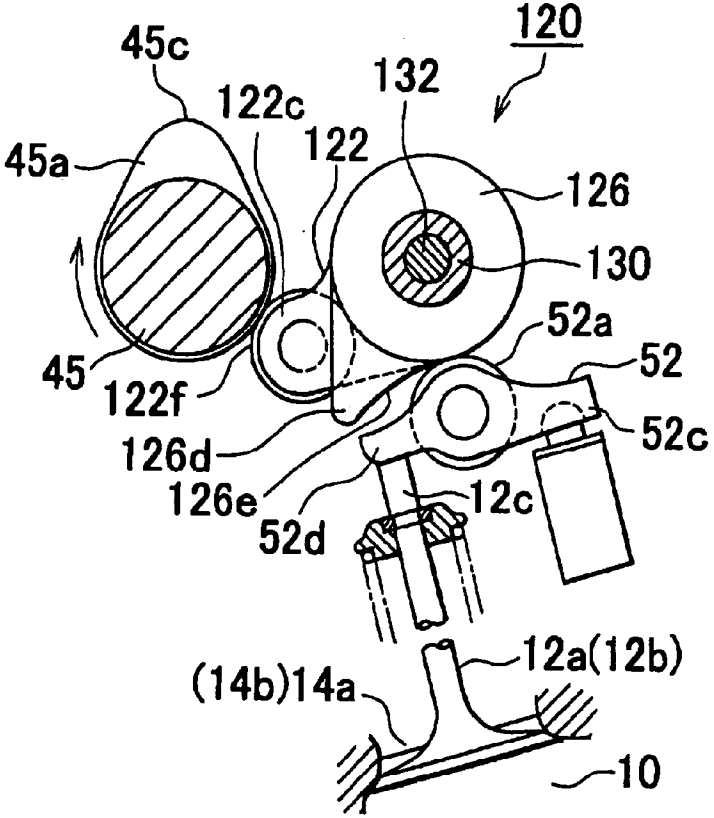
FIGS. 17A and 17B illustrate the function of the intervening actuation mechanism in the first embodiment.
Figure 17B:
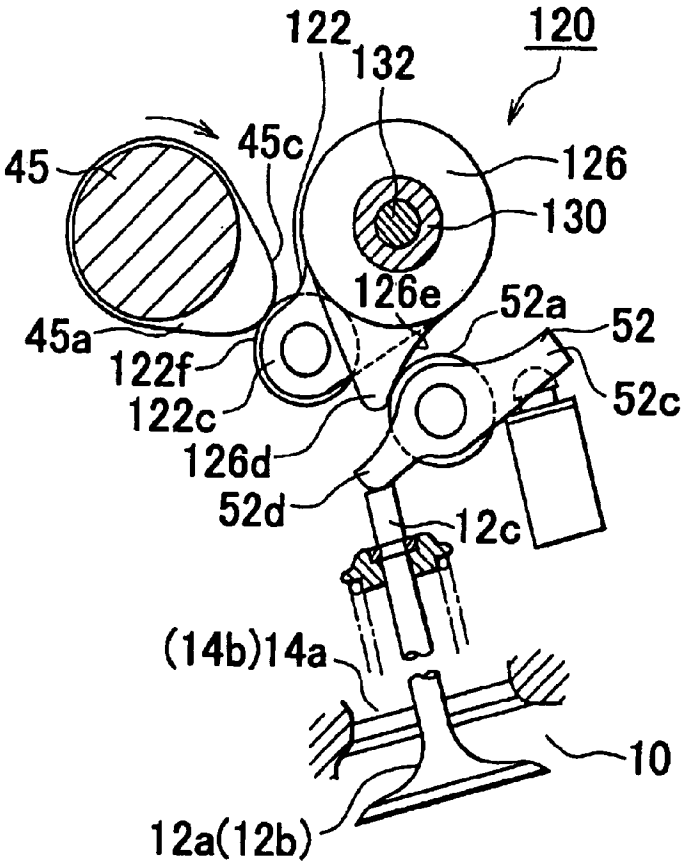

FIGS. 17A and 17B illustrate a state of the intervening actuation mechanism 120 in which the control shaft 132 has been moved by the slide actuator 100 to a limit in the direction H. During this state, the first array of pins 128*c* of the slider gear 128 is in mesh with the large-operation angle helical spline set 125*b* of the first oscillating cam 124 shown in FIGS. 11 and 12. Similarly, the second array of pins 128*e* of the slider gear 128 is in mesh with the large-operation angle helical spline set 127*b* of the second oscillating cam 2 shown in FIGS. 11 and 12. That is, the oscillating cams 124, 126 have been pivoted from the state shown in FIGS. 16A and 16B by the large-operation angle helical spline sets 125*b*, 127*b*. The relationship between the slider gear 128 and the oscillating cams 124, 126 during this state is indicated in the perspective view of FIG. 5.

In FIG. 17A, the base circle portion of the intake cam 45*a* is in contact with the roller 122*f* of the input section 122 of the intervening actuation mechanism 120. During this state, the noses 124*d*, 126*d* of the oscillating cams 124, 126 are not in contact with the rollers 52*a* of the roller rocker arms 52, but are in contact with the base circle portions that are near the noses 124*d*, 126*d*, so that the intake valves 12*a*, 12*b* are in the closed state. When the nose 45*c* of the intake cam 45*a* pushes the roller 122*f* of the input section 122 as the intake camshaft 45 rotates, the curved cam surfaces 124*e*, 126*e* of the noses 124*d*, 126*d* immediately contact the rollers 52*a* of the roller rocker arms 52. Therefore, the entire area of each nose 124*d*, 126*d* is used to push the roller 52*a* of the roller rocker arm 52 down, as indicated in FIG. 17B. Hence, each roller rocker arm 52 is pivoted about the base end portion 52*c*, and the distal end portion 52*d* of the roller rocker arm 52 pushes the stem end 12*c* to a maximum displacement. In this manner, the intake valves 12*a*, 12*b* achieve the open state of the intake ports 14*a*, 14*b* with a maximum valve operation angle.

Figure 18:
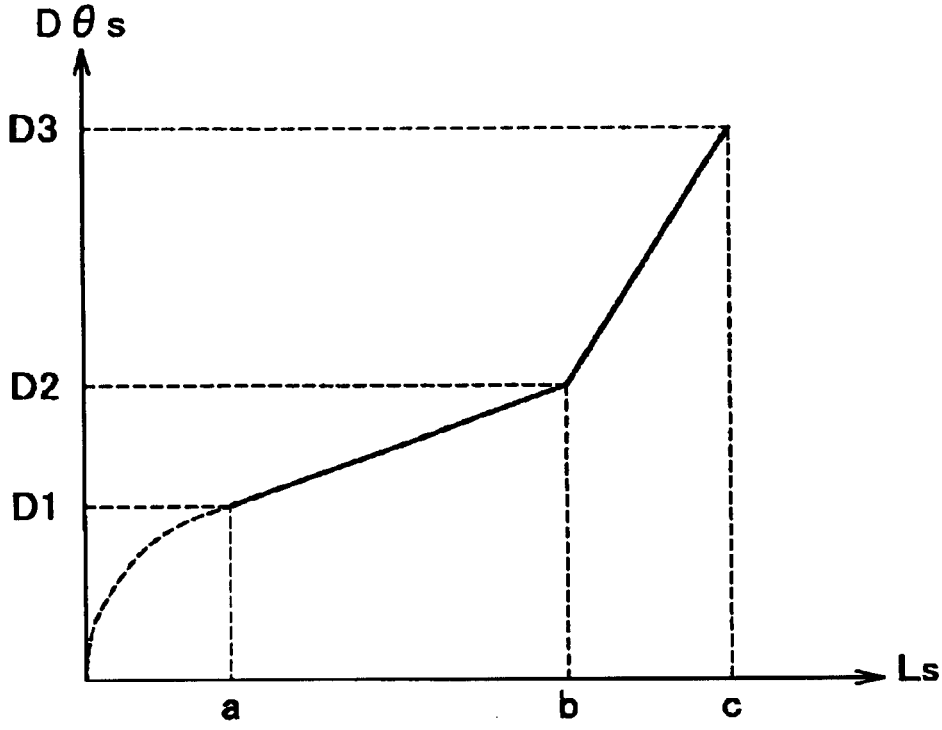
FIG. 18 is a diagram indicating a relationship between the actual shaft displacement Ls and the actual valve operation angle Dθs in the first embodiment.

Since the oscillating cams 124, 126 are provided with the small-operation angle helical spline sets 125*a*, 127*a* and the large-operation angle helical spline sets 125*b*, 127*b* as described above, the relationship between the actual shaft displacement Ls of the control shaft 132 and the actual valve operation angle Dθs is a non-linear relationship as indicated in FIG. 18. A solid line segment in FIG. 18 is a portion of the non-linear relationship line which is used for the operation of the engine (where the engine operation is possible), and will be described below. In a region (a–b) where the actual shaft displacement Ls is small, that is, a region (D1–D2) where the actual valve operation angle Dθs is small, the change in the actual valve operation angle Dθs with respect to a change in the actual shaft displacement Ls is small. However, in a region (b–c) where the actual shaft displacement Ls is large, that is, a region (D2–D3) where the actual valve operation angle Dθs is large, the change in the actual valve operation angle Dθs with respect to a change in the actual shaft displacement Ls is large. For example, the actual valve operation angle D1 is set at 100° C.A, and the actual valve operation angle D2 is set at 160° C.A, and the actual valve operation angle D3 is set at 260° C.A, as indicated in FIG. 13.

Figure 19:
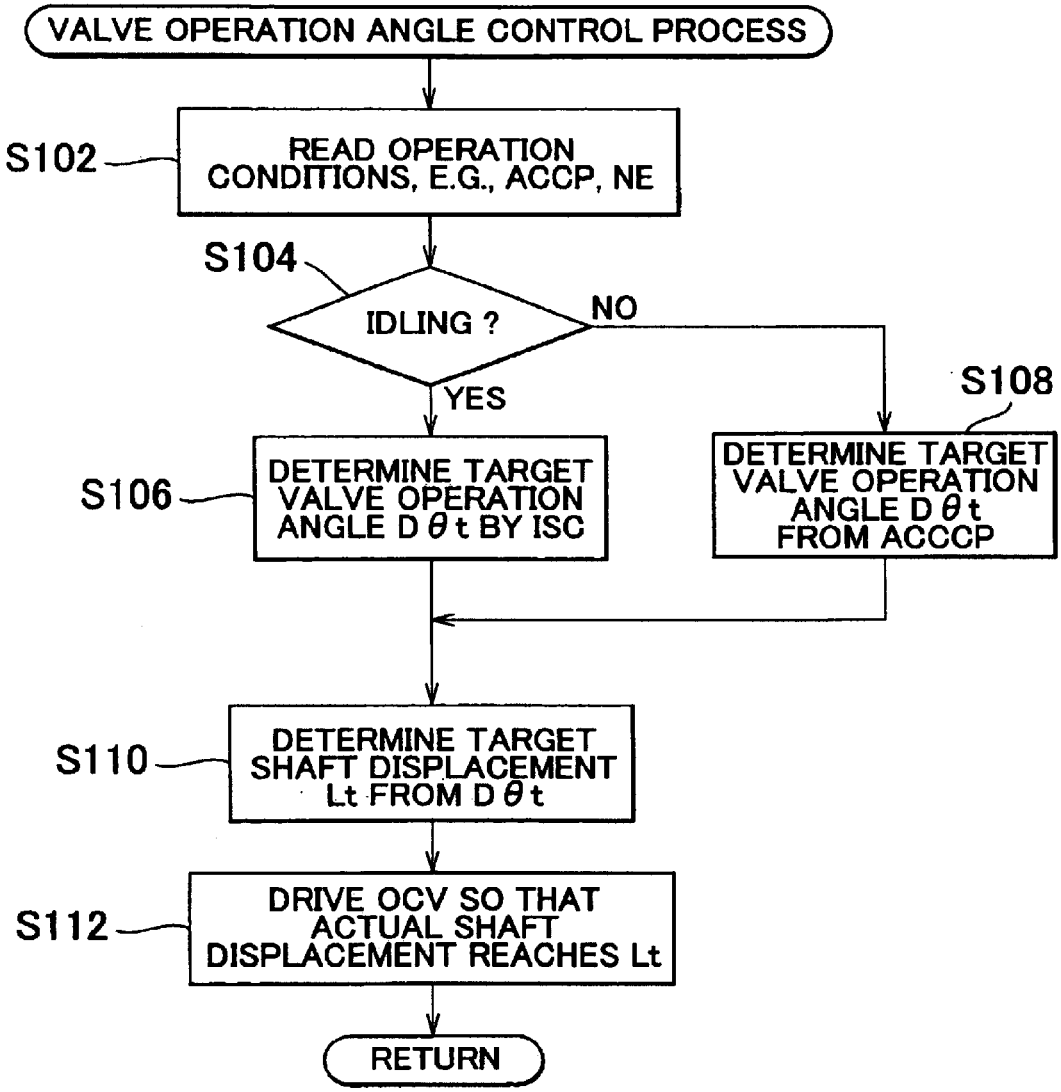
FIG. 19 is a flowchart illustrating a valve operation angle control process executed by an ECU in the first embodiment.

The valve operation angle control of the intake valves 12*a*, 12*b* executed by the ECU 60 will next be described. FIG. 19 shows a flowchart illustrating a valve operation angle control process. This control process is cyclically executed at time intervals. In the flowchart, the individual steps are represented by "S" together with the step Nos.

When the valve operation angle control process starts, the ECU 60 inputs into a working area of the RAM the engine operational conditions, for example, the accelerator operation amount ACCP determined on the basis of the signal from the accelerator operation sensor 76, the engine rotation speed NE determined on the basis of the signal from the crank angle sensor 82, etc. (S102).

Subsequently, it is determined whether the engine is idling (S104). If the engine is idling ("YES" at S104), calculation of a target valve operation angle Dθt by an idling speed control (ISC) is performed (S106). That is, a target valve operation angle Dθt for achieving a target idling speed is determined by feedback calculation.

Figure 20:
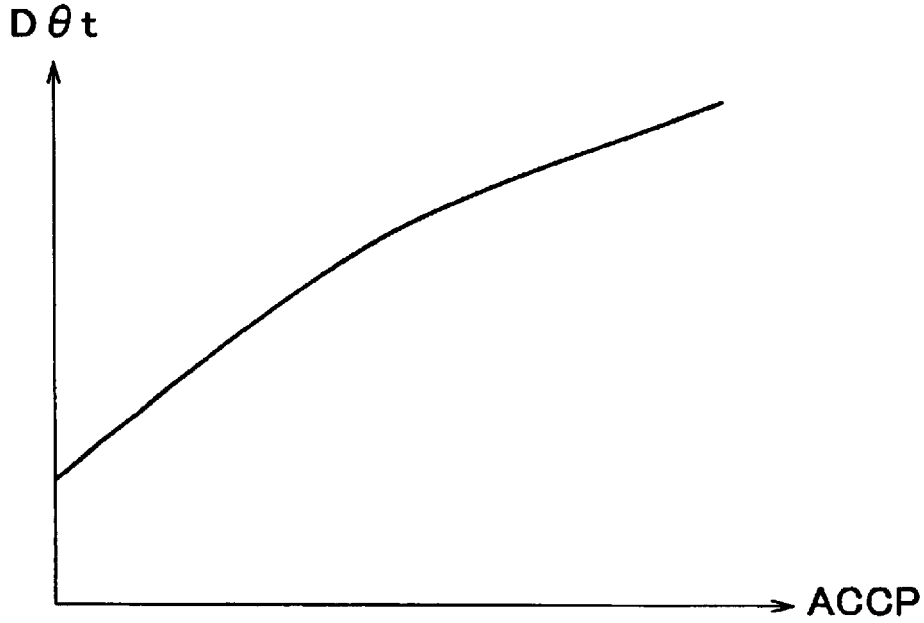
FIG. 20 indicates a map for determining a target valve operation angle Dθt for use in the valve operation angle control process.

Conversely, if the engine is not idling ("NO" at S104), a target valve operation angle Dθt is determined from the value of the accelerator operation amount ACCP with reference to a map shown in FIG. 20 (S108).

Figure 21:
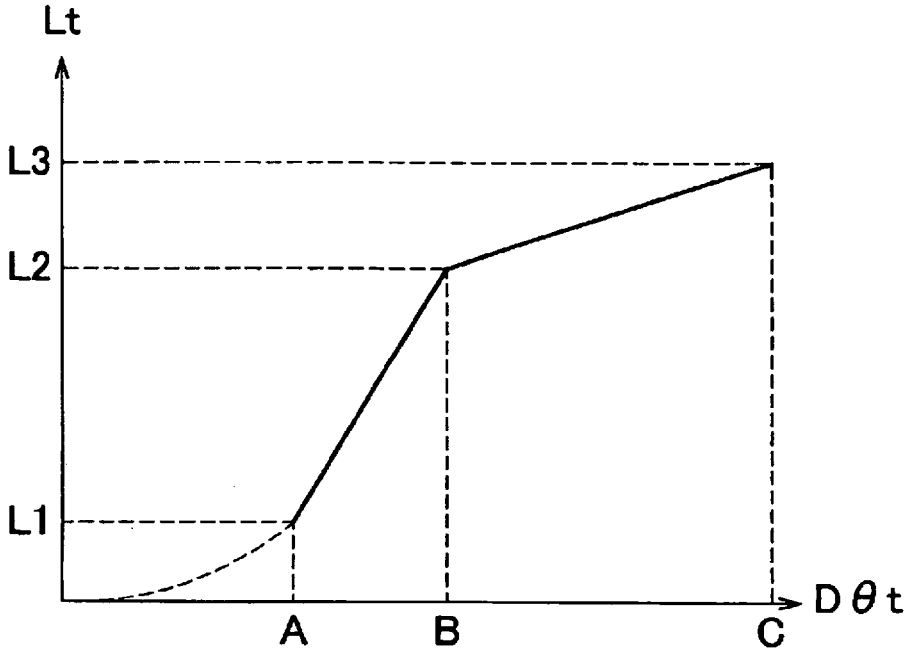
FIG. 21 indicates a map for determining a target shaft displacement Lt for use in the valve operation angle control process.

After a target valve operation angle Dθt is determined in S106 or S108, a target shaft displacement Lt is determined from the target valve operation angle Dθt with reference to a map shown in FIG. 21 (S110). The map shown in FIG. 21 is set on the basis of the graph shown in FIG. 18. The OCV 104 is actuated so that the actual shaft displacement of the control shaft 132 becomes equal to the target shaft displacement Lt (S112). Then, the process temporarily ends.

Due to cyclical executions of the above-described process, the amount of intake air requested by the ISC or a driving person is adjusted in accordance with the magnitude of the valve operation angle of the intake valves 12*a*, 12*b*.

As indicated in the map of FIG. 21, the width L1–L2 of control of the target shaft displacement Lt with respect to the control width A–B of the target valve operation angle Dθt for small amounts of intake air is greater than the control width L2–L3 of the target shaft displacement Lt with respect to the control width B–C of the target valve operation angle Dθt for large amounts of intake air. This means that the control of the valve operation angle by the OCV 104 can be executed with a higher precision for small amounts of intake air than for large amounts of intake air.

In the above-described construction, the mechanism that is formed by a combination of the helical splines 122*b*, 124*b*, 126*b*, 128*a* and the arrays of pins 128*c*, 128*e* and that adjusts the relative phase difference between the input section 122 and the oscillating cams 124, 126 corresponds to a spline mechanism portion.

The above-described first embodiment achieves the following advantages.

(I) The above-described valve lift adjustment mechanism that includes the intervening actuation mechanism 120 is able to adjust the valve operation angle with a higher precision in a region where the valve operation angle is relatively small than in a region where the valve operation angle is relatively large.

In the intake air amount control performed by adjustment of the valve operation angle of the intake valves 12*a*, 12*b*, it is necessary to adjust the valve operation angle with an increased precision when the valve operation angle is relatively small (when the amount of intake air is relatively small). In a region of relatively large valve operation angles (a region of relatively large amounts of intake air), a precision that is less than the precision of the control in a region of relatively small valve operation angles does not cause a problem in the engine control. The provision of increased control precision only for the region of relatively small valve operation angles causes no problem in the engine control.

If increased precision is to be achieved over the entire range of valve operation angle, all the helical splines 124*b*, 126*b* of the oscillating cams 124, 126 will need to have small angles of inclination comparable to the angle of inclination of the small-operation angle helical splines 125*a*, 127*a*. This design requires considerably increased axial lengths of the oscillating cams 124, 126, in order to sufficiently pivot the noses 124*d*, 126*d*.

In the foregoing embodiment, however, only the region of relatively small valve operation angles is provided with a high control precision, that is, a reduced rate of conversion from the amount of actuation of the control shaft 132 into the amount of change in the valve operation angle. Therefore, the embodiment curbs the increase in the length of the oscillating cams 124, 126 in the direction of the axis, and curbs the size increase of the intervening actuation mechanism 120.

Therefore, it becomes easy to incorporate the variable valve mechanism into the engine 2. Furthermore, the incorporation of the variable valve mechanism will not produce a problem in the operation control of the engine 2.

Second Embodiment

Figure 22:
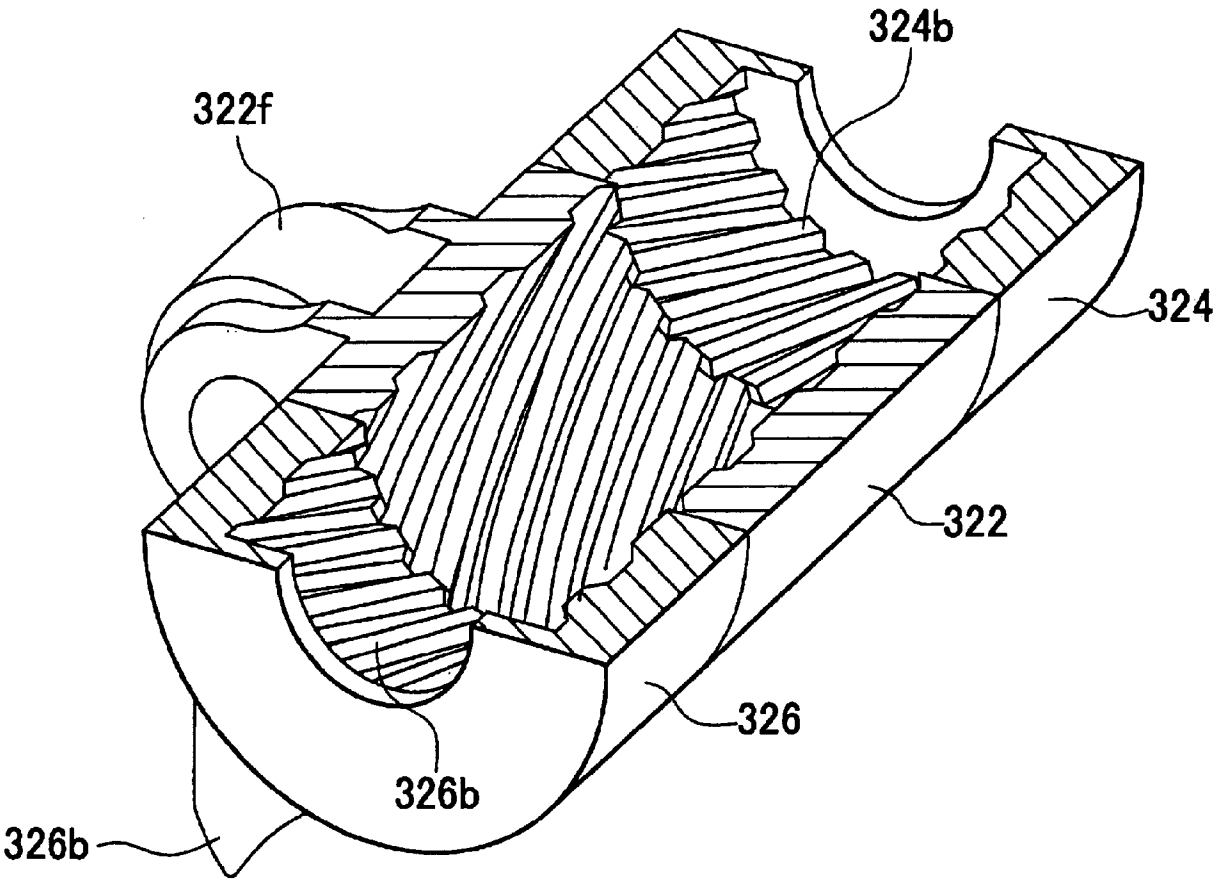
FIG. 22 is a cutaway perspective view of an input section and oscillating cams in accordance with a second embodiment of the invention.

Features of a second embodiment are that internal helical splines 324*b*, 326*b* of oscillating cams 324, 326 of an intervening actuation mechanism are provided with a single angle of inclination as shown in FIG. 22 (corresponding to FIG. 11 of the first embodiment), and that the cam profile of intake cams is different from that in the first embodiment. In other respects, the second embodiment has substantially the same construction as the first embodiment.

Since the helical splines 324*b*, 326*b* of the oscillating cams 324, 326 have a fixed angle of inclination, the relative phase difference between a roller 322*f* of an input section 322 and noses 324*d*, 326*d* (nose 324*d* is not shown) of the oscillating cams 324, 326 changes constantly at a fixed rate with respect to the displacement of a control shaft.

Figure 23:
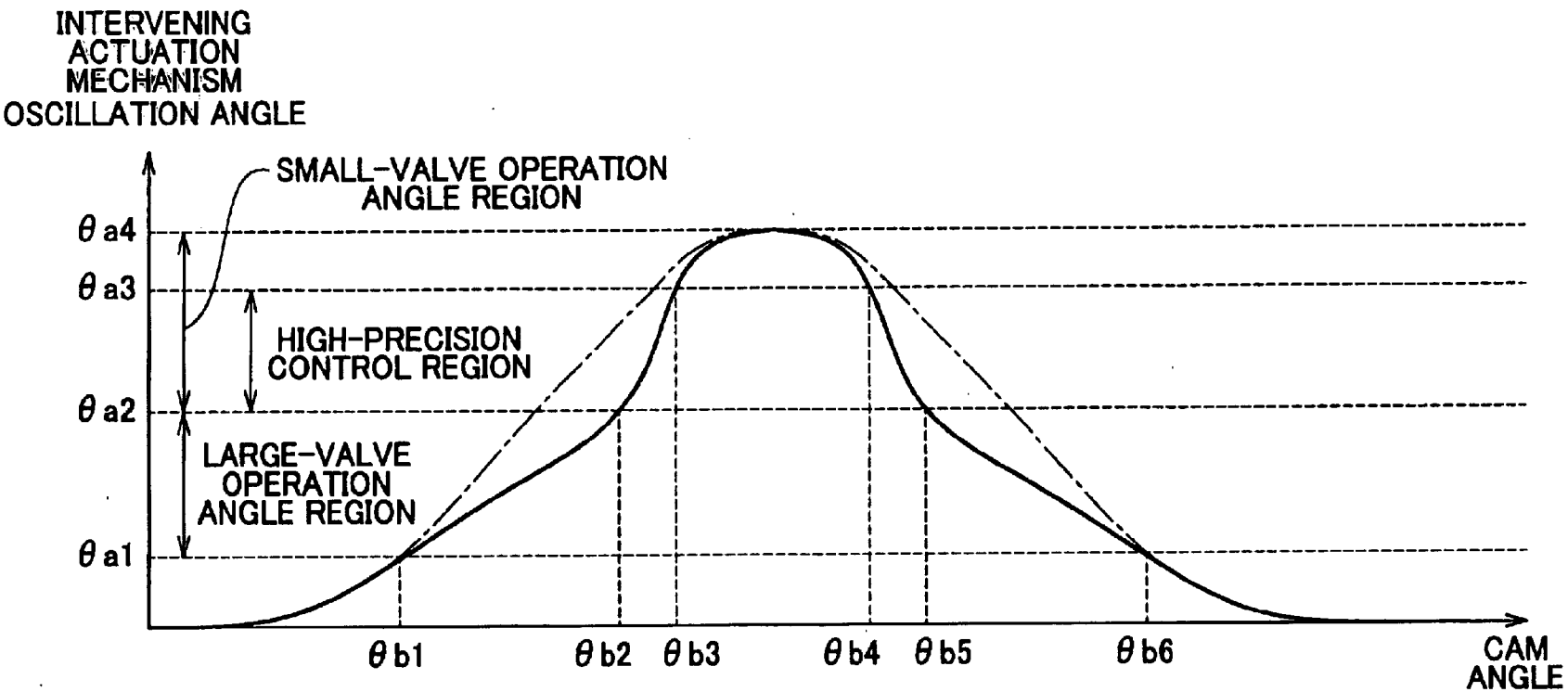
FIG. 23 is a graph indicating a relationship between the cam angle and the oscillation angle of an intervening actuation mechanism in the second embodiment.

An intake cam profile is indicated by a solid line in FIG. 23. The horizontal axis in FIG. 23 indicates the cam angle (corresponding to the crank angle as well), and the vertical axis indicates the change in the oscillation angle of the intervening actuation mechanism. As for the change in the oscillation angle of the intervening actuation mechanism, if the shaft displacement of the control shaft is small, the depression of the roller rocker arms by the noses 324*d*, 326*d* of the oscillating cams 324, 326 begins at a point that is high with respect to the vertical axis, so that the valve operation angle is reduced. Conversely, if the shaft displacement is great, the depression of the roller rocker arms begins at a point that is low with respect to the vertical axis, so that the valve operation angle is increased.

The cam profile of intake cams is predetermined so that the change in the open-close timing of the intake valves in accordance with rotation of the intake valves is increased if the open-close timing is within a large-valve operation angle region (θa1–θa2) in which relatively low-precision adjustment of the valve operation angle, instead of high-precision adjustment, does not produce a problem in the operation control of the engine. That is, in the ranges of cam angle θb1–θb2, θb5–θb6 corresponding to cam profile portions remote from the distal end of the cam nose of the intake valve, the change in the open-close timing (the horizontal axis in FIG. 23), that is, the change in the valve operation angle, with respect to the change in the oscillation angle (the vertical axis in FIG. 23) caused by the control shaft, is increased.

In a small-valve operation angle region (θa2–θa4), the valve operation angle needs to be adjusted with high precision. Within the small-valve operation angle region (θa2–θa4), the region where the valve operation angle is actually adjusted for the engine control is a high-precision control region (θa2–θa3) indicated in FIG. 23. If the open-close timing of the intake valves 12*a*, 12*b* is in the high-precision control region (θa2–θa3), the change in the open-close timing in accordance with rotation of the intake valves is reduced. That is, in the ranges of cam angle θb2–θb3, θb4–θb5 corresponding to cam profile portions near the distal end of the nose of the intake cam, the change in the open-close timing (the horizontal axis in FIG. 23), that is, the change in the valve operation angle, with respect to the change in the oscillation angle caused by the control shaft (the vertical axis in FIG. 23), is small.

Figure 24:
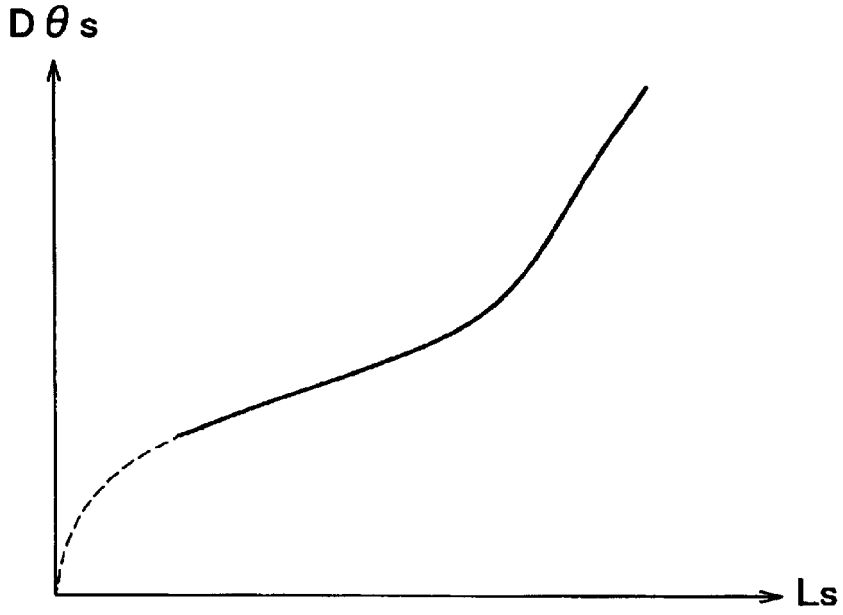
FIG. 24 is a diagram indicating a relationship between the actual shaft displacement Ls and the actual valve operation angle Dθs in the second embodiment.
Figure 25:
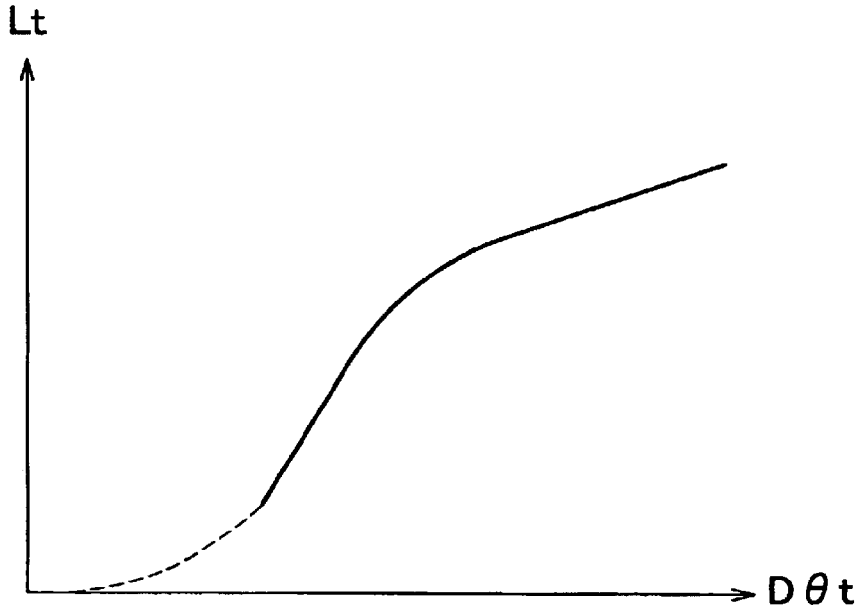
FIG. 25 indicates a map for determining a target shaft displacement Lt in the second embodiment.

It is to be noted that the cam profile of the intake cam 45*a* used in the first embodiment is indicated by a one-dot chain line in FIG. 23. Therefore, the relationship between the actual shaft displacement Ls and the actual valve operation angle Dθs is a nonlinear relationship as indicated in FIG. 24, and the map used in step S110 in the valve operation angle control process (FIG. 19) is a map as indicated in FIG. 25.

The above-described second embodiment achieves the following advantages.

(I) In the second embodiment, the rate of conversion from the amount of movement of the control shaft 132 in the direction of the axis into the amount of change in the valve operation angle is reduced in a small-valve operation angle region, due to the intake cam profile set as indicated in FIG. 23, instead of the intervening actuation mechanism designed as in the first embodiment.

Therefore, according to the second embodiment, when the operation angle of the intake valves actuated by the oscillating cams 324, 326 is small, the rate of conversion from the axial movement of the control shaft into the amount of change in the valve operation angle is reduced, so that the precision in adjustment of the valve operation angle is increased.

Conversely, when the operation angle of the intake valves actuated by the oscillating cams 324, 326 is large, the rate of conversion from the axial movement of the control shaft into the amount of change in the valve operation angle is not reduced, so that the precision in adjustment of the valve operation angle is not high in comparison with the precision achieved when the operation angle of the intake valves is small.

Thus, the variable valve mechanism can be provided without a size increase. Therefore, the variable valve mechanism can easily be incorporated into the engine. Furthermore, the variable valve mechanism will not produce a problem in the operation control of the engine 2.

Third Embodiment

Figure 26:
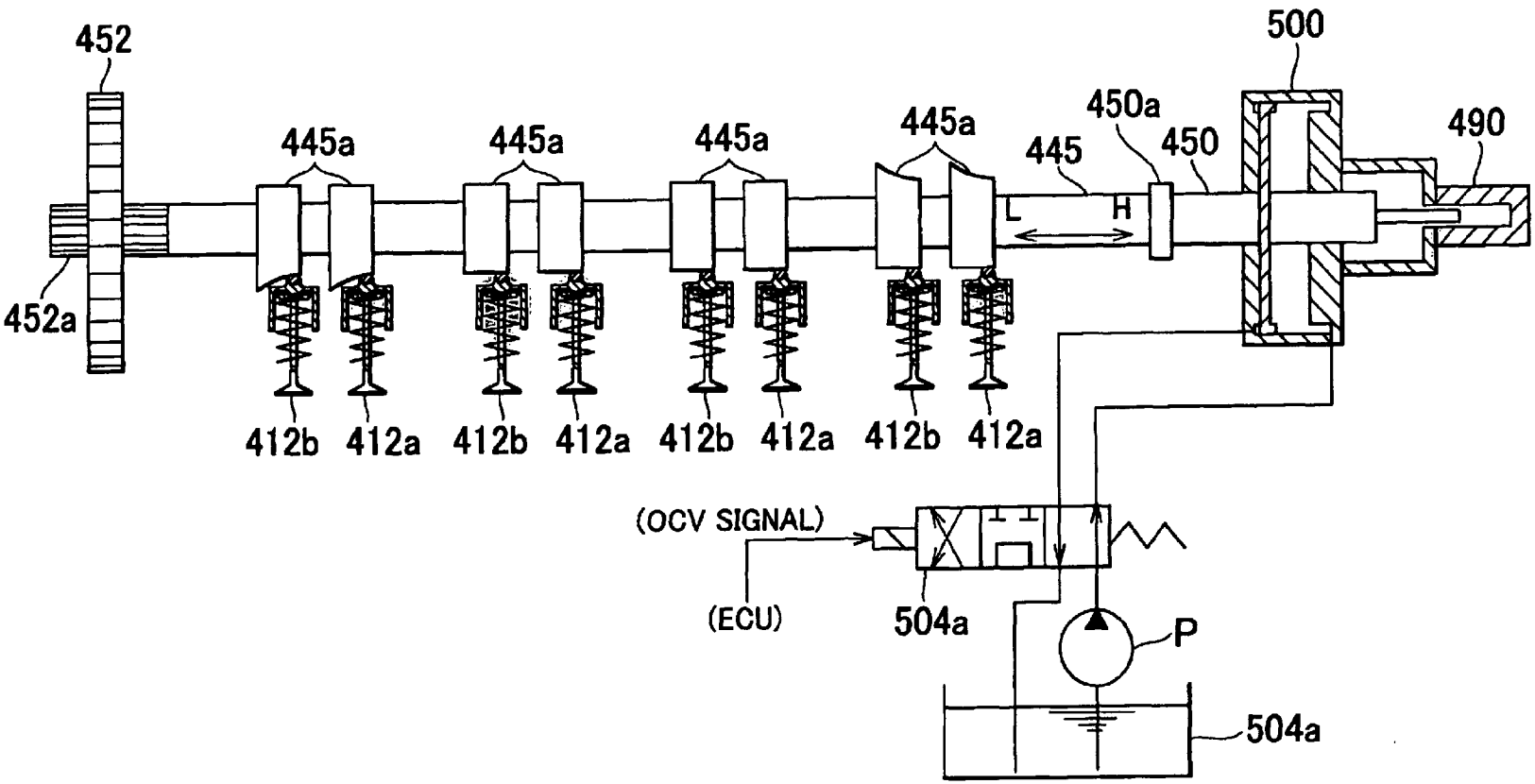
FIG. 26 illustrates a construction of a variable valve operation angle mechanism in accordance with a third embodiment of the invention.

In a third embodiment, the adjustment of the valve lift of intake valves 412*a*, 412*b* is performed without the use of an intervening actuation mechanism, as shown in FIG. 26. Instead, the adjustment of the valve lift of the intake valves 412*a*, 412*b* is performed by a slide actuator 500 moving an auxiliary shaft 450 connected to an intake camshaft 445 via a rolling bearing portion 450*a*, in the direction of an axis.

The intake camshaft 445 is rotated in association with the rotation of a crankshaft of an engine, via a timing sprocket (that may be replaced by a timing gear or a timing pulley) provided at an end of the intake camshaft 445. However, the auxiliary shaft 450 is not rotatable in association with the rotation of the intake camshaft 445 since the auxiliary shaft 450 is connected to the intake camshaft 445 via the rolling bearing portion 450*a*. The auxiliary shaft 450 is movable together with the intake camshaft 445 as a unit only in the direction of the axis; The timing sprocket 452 connected to the intake camshaft 445 is supported on a cylinder block of an engine so that the timing sprocket 452 is rotatable but is axially unmovable with respect to the cylinder block. The timing sprocket 452 is connected at a central portion thereof to the intake camshaft 445 via a straight spline mechanism 452*a*, and therefore allows the intake camshaft 445 to move in the direction of the axis.

Figure 27:
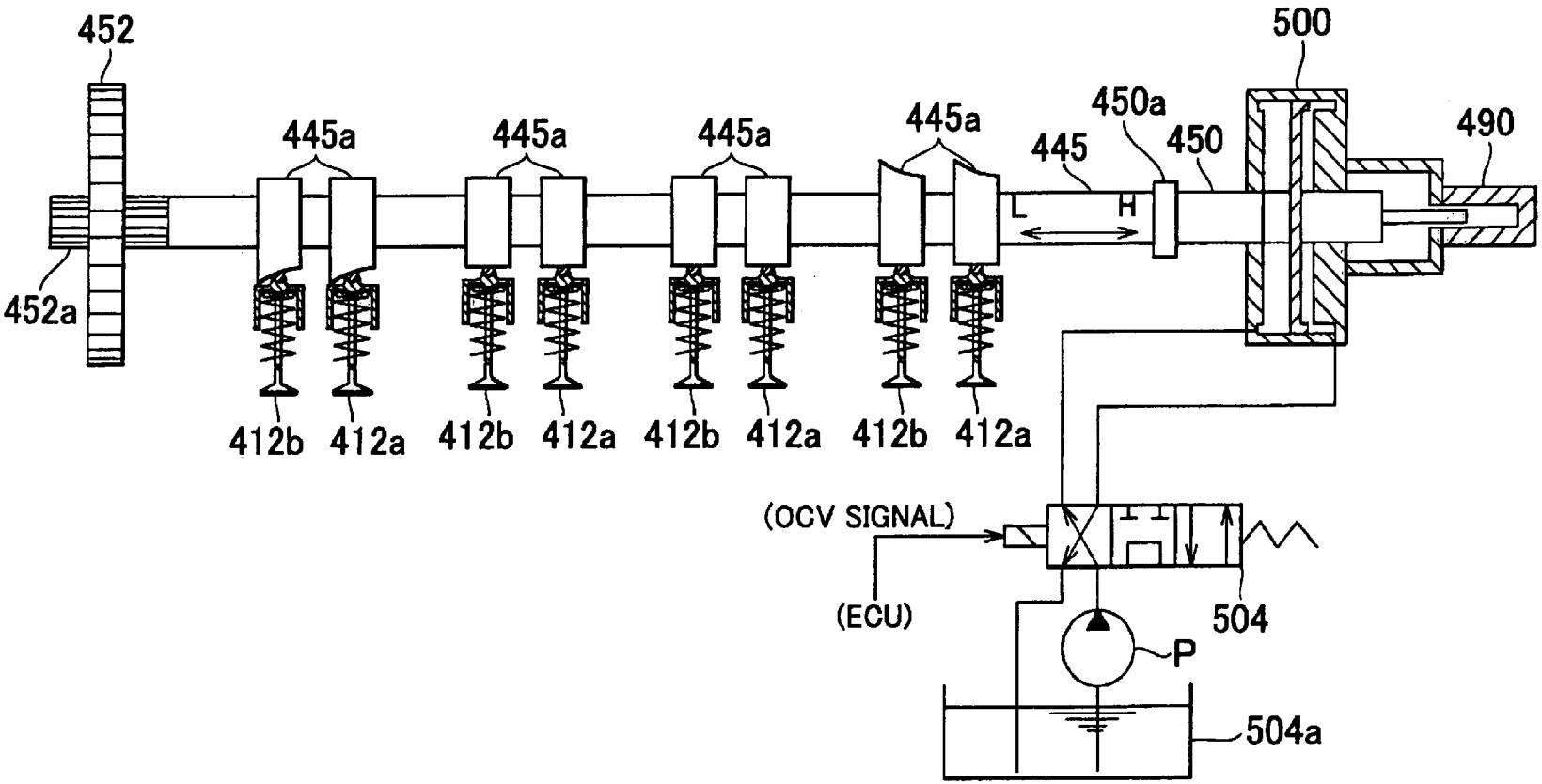
FIG. 27 illustrates the function of the variable valve operation angle mechanism in the third embodiment.
Figure 28:
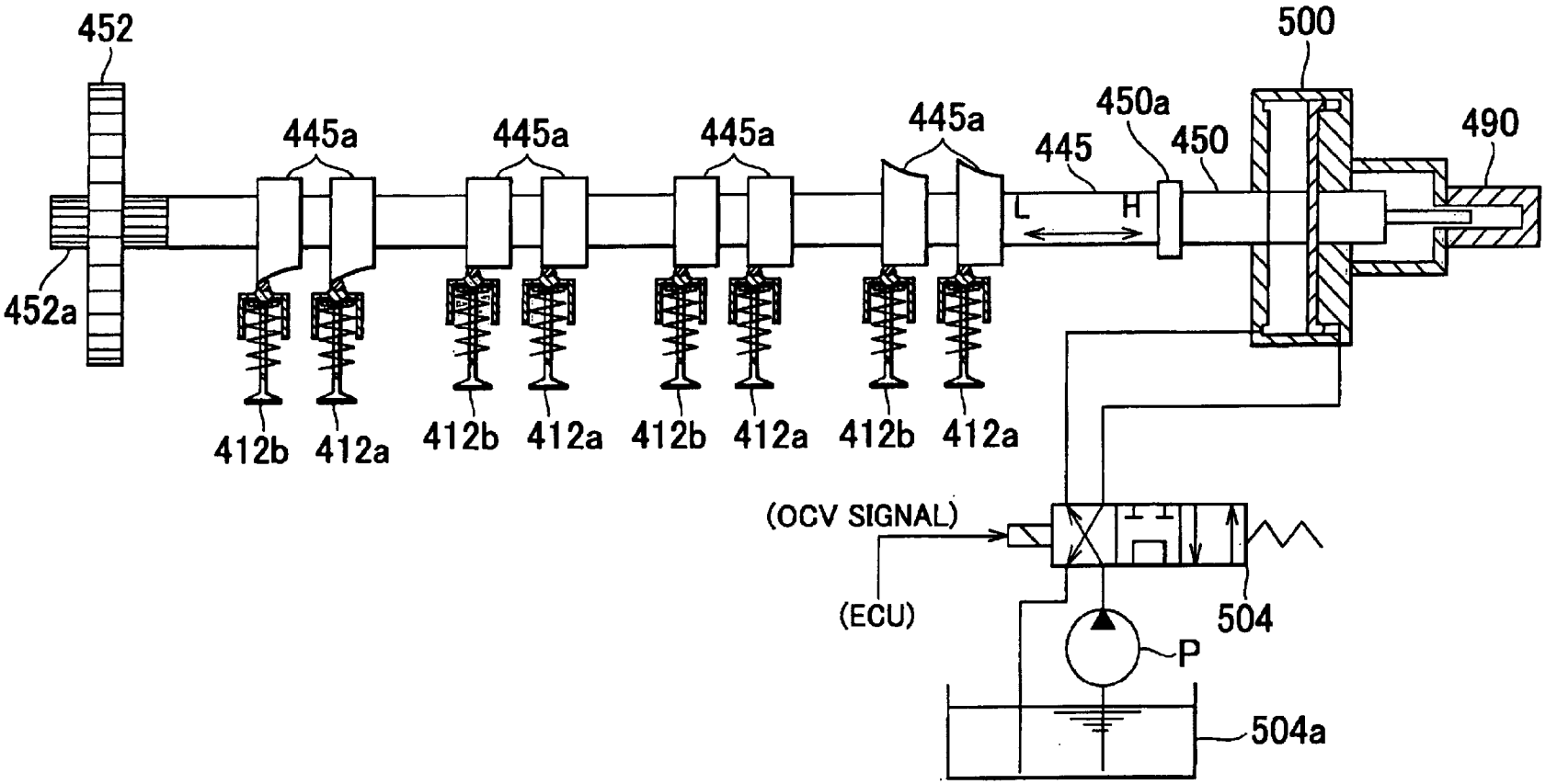
FIG. 28 illustrates the function of the variable valve operation angle mechanism in the third embodiment.

The slide actuator 500 is provided with a shaft position sensor 490 that detects the position of the auxiliary shaft 450. An OCV 504 adjusts the supply of hydraulic fluid from an oil pump P to the slide actuator 500. The oil pump P pumps hydraulic fluid from an oil pan 504*a*. Therefore, the above-described arrangement is able to minimize the valve operation angle as indicated in FIG. 26, and is able to achieve an intermediate valve operation angle by moving the intake camshaft 445 in the direction of the axis as indicated in FIG. 27, and is able to maximize the valve operation angle as indicated in FIG. 28.

Figure 29A:
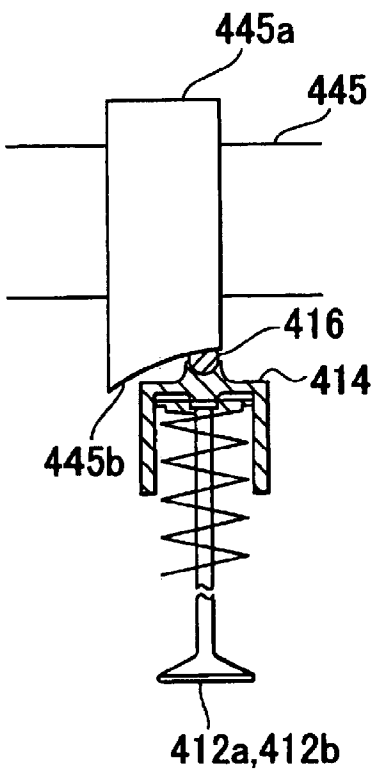
FIGS. 29A to 29C illustrate the cam profile and the function of an intake cam in the third embodiment.
Figure 29B:
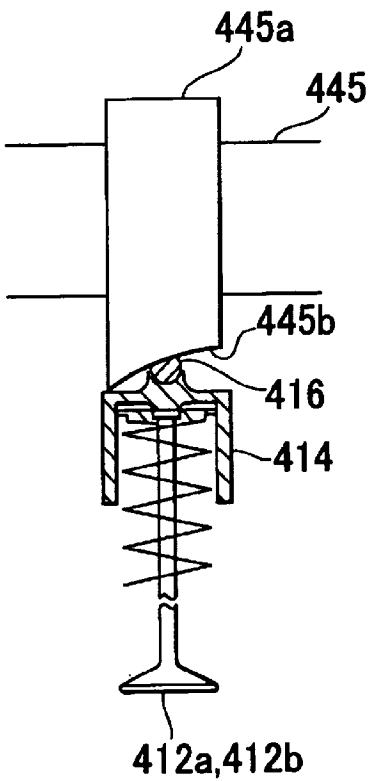
Figure 29C:
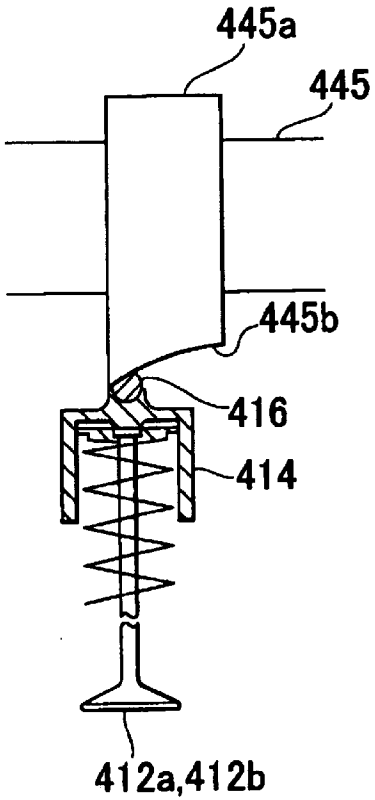

Each intake cam 445*a* provided on the intake camshaft 445 is a three-dimensional cam whose profile continuously changes in the direction of the axis. Specifically, as shown in FIGS. 29A to 29C, each intake cam 445*a* is formed so that the cam nose is low on the right side in the drawings, and gradually becomes higher toward the left side end in the drawings. As for the change of the cam nose, the rate of increase in the height of the cam nose with respect to the positional shift in the leftward direction in the drawings is low in a side region where the cam nose 445*b* is low (the right side in the drawings). The height of the cam nose 445*b* rapidly increases with approach to the high-cam nose side (the left side end in the drawings). Therefore, the valve operation angle relatively gently increases during an initial period in the transition from the state shown in FIG. 29A where a cam follower 416 provided on a valve lifter 414 contacts a right-side end portion of the intake cam 445*a* to the state shown in FIG. 29C where the cam follower 416 contacts a left-side end portion of the intake cam 445*a*, via the state shown in FIG. 29B. Then, the rate of increase in the valve operation angle gradually increases, and sharp increases in the valve operation angle occur near the left-side end of the intake cam 445*a*.

Figure 30:
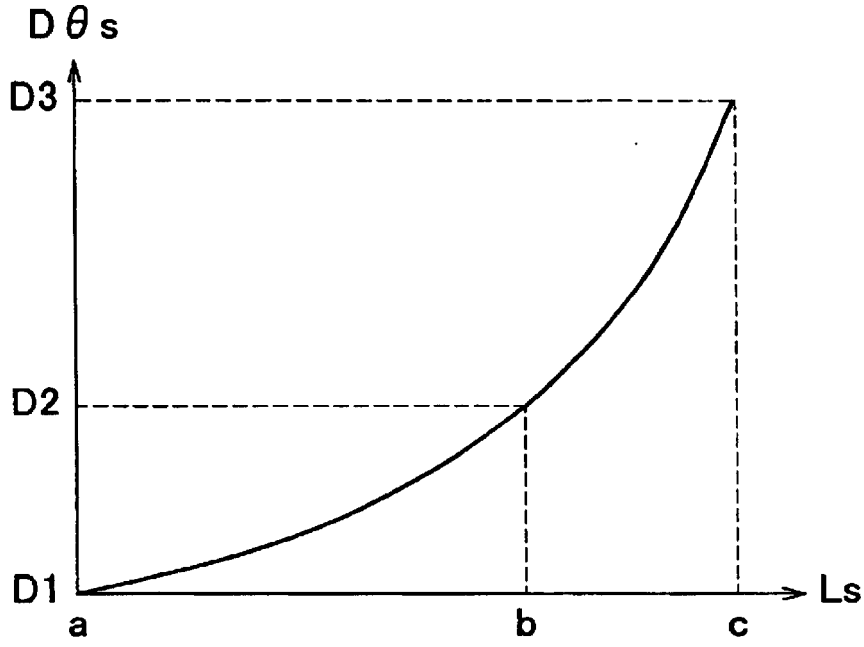
FIG. 30 is a diagram indicating a relationship between the actual shaft displacement Ls and the actual valve operation angle Dθs in the third embodiment.
Figure 31:
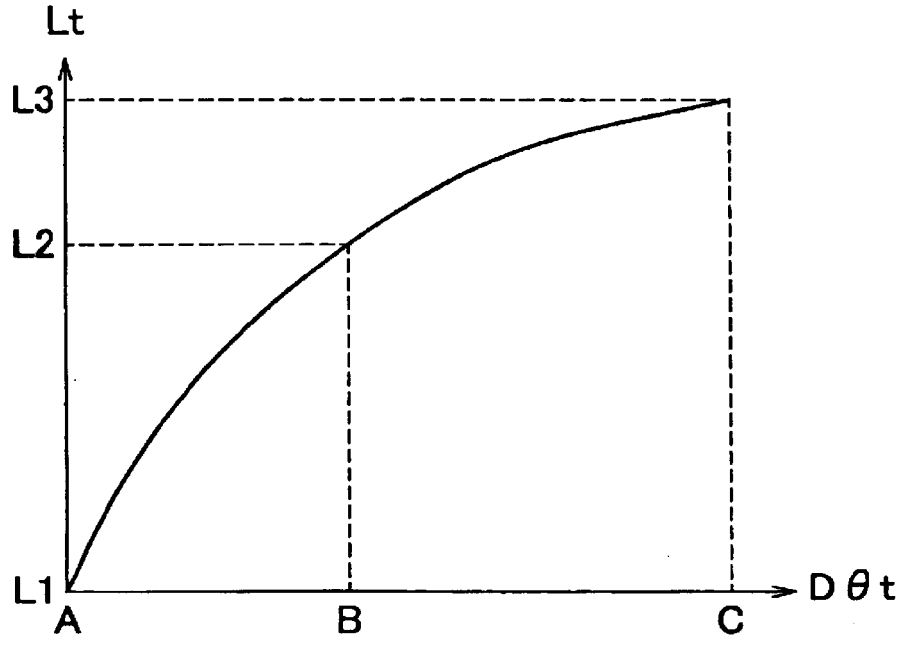
FIG. 31 indicates a map for determining a target shaft displacement Lt in the third embodiment.

Due to the above-described change in the cam profile, the relationship between the actual shaft displacement Ls of the auxiliary shaft 450 and the actual valve operation angle Dθs is a non-linear relationship indicated by a curved line in FIG. 30. Therefore, a map shown in FIG. 31 is used in step S110 in the valve operation angle control process (FIG. 19).

The above-described third embodiment achieves the following advantages.

(I) As indicated in FIG. 30, the change in the actual valve operation angle Dθs with respect to a change in the actual shaft displacement Ls is small in a region (a–b) where the actual shaft displacement Ls is small, that is, a region (D1–D2) where the actual valve operation angle Dθs is small. In contrast, the change in the actual valve operation angle Dθs with respect to a change in the actual shaft displacement Ls is large in a region (b–c) where the actual shaft displacement Ls is large, that is, a region (D2–D3) where the actual valve operation angle Dθs is large.

Through the use of the intake cams 445*a* whose cam profile changes as described above, the rate of conversion from the amount of axial movement of the intake cams 445*a* into the amount of change in the valve operation angle is made smaller in a small-valve operation angle region than in a large-valve operation angle region. Therefore, the valve operation angle is adjusted with a higher precision in the small-valve operation angle region than in the large-valve operation angle region, even though the slide actuator 500 moves the intake cams 445*a* constantly with a fixed precision.

The rate of conversion from the amount of movement of the intake cams 445*a* into the amount of change in the valve operation angle is reduced only at the side of small valve operation angles. Therefore, it becomes possible to prevent a size increase of the entire arrangement of the valve lift adjustment mechanism that includes the intake cams 445*a*, the intake camshaft 445, the bearing portion 450*a*, the auxiliary shaft 450, the slide actuator 500 and the shaft position sensor 490. Hence, the mechanism can easily be incorporated into the engine. Furthermore, the mechanism does not produce a problem in the operation control of the engine.

Other Embodiments (a) In the first embodiment, the helical spline arrangement that includes small-valve operation angle helical splines and large-valve operation angle helical splines is provided on the oscillating cam side, and the arrays of pins are provided on the slider gear side. However, it is also possible to provide arrays of pins within oscillating cams and provide helical spline arrangements each of which includes small-valve operation angle helical splines and large-valve operation angle helical splines on the outer peripheral surfaces of two opposite end portions of a slider gear.

Figure 32:
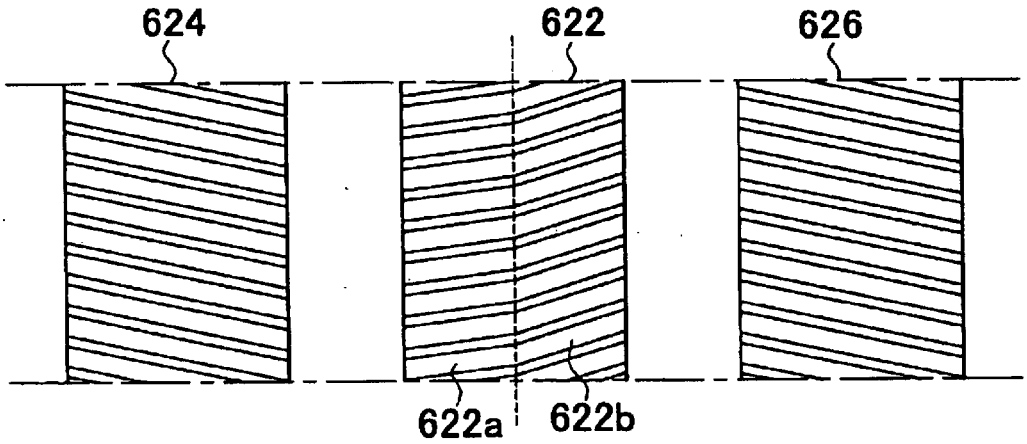
FIG. 32 is a developed view of an arrangement of helical splines in accordance with a further embodiment of the invention.

Furthermore, it is possible to adopt a spline construction as shown in the developed view of FIG. 32 in which helical splines with a fixed angle of inclination are formed on oscillating cams 624, 626, and a helical spline arrangement that includes small-valve operation angle helical splines 622*a* and large-valve operation angle helical splines 622*b* is formed on an input section 622. With this construction, a slider gear is provided with an array of pins in place of the input helical splines. Furthermore, the outer peripheral surfaces of the two opposite end portions of the slider gear may be provided with helical splines instead of the arrays of pins.

Figure 33:
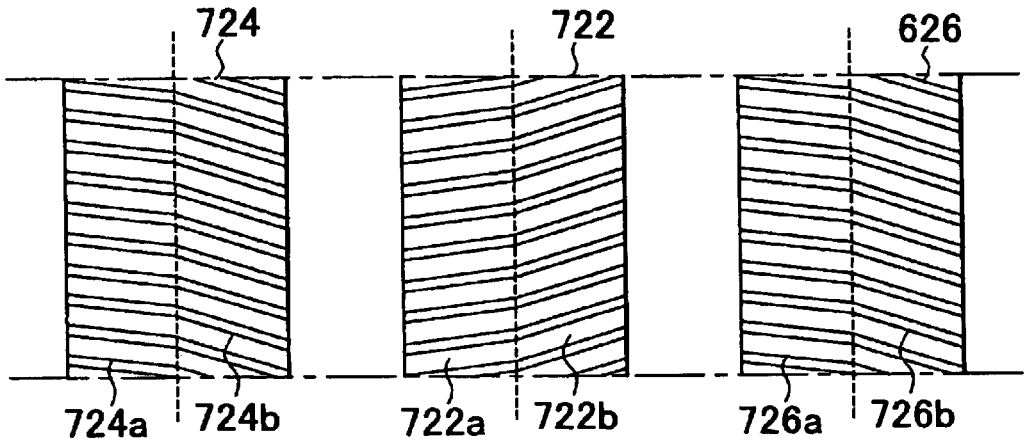
FIG. 33 is a developed view of an arrangement of helical splines in accordance with a still further embodiment.

In another possible construction, a slider gear is provided with arrays of pins without any spline, and as shown in the developed view of FIG. 33, each of oscillating cams 724, 726 and an input section 722 is provided with a helical spline arrangement that includes a small-valve operation angle helical spline set 722*a*, 724*a*, 726*a* and a large-valve operation angle helical spline set 722*b*, 724*b*, 726*b*.

Conversely, a slider gear may be provided with helical splines including small-valve operation angle helical splines and large-valve operation angle helical splines without an array of pins, and oscillating cams and an input section may be provided only with arrays of pins.

(b) In the first embodiment, the angle of inclination of helical splines un-smoothly changes between the set of small-valve operation angle helical splines and the set of large-valve operation angle helical splines. Instead, the angle of inclination of helical splines may be smoothly changed so as to achieve a relationship, for example, as indicated in FIG. 24 of the second embodiment or FIG. 30 of the third embodiment, within a range of control of operation of the internal combustion engine.

In the second embodiment, the cam profile of the intake cams may be designed so that the actual shaft displacement Ls and the actual valve operation angle Dθs un-smoothly change with respect to each other as indicated in FIG. 18 of the first embodiment, within a range of control of operation of the internal combustion engine. The cam profile of the intake cams may also be designed so as to achieve a relationship as indicated in FIG. 30 of the third embodiment, within a range of control of operation of the internal combustion engine.

Similarly, in the third embodiment, the cam nose of each three-dimensional cam may be formed so that the actual shaft displacement Ls and the actual valve operation angle Dθs un-smoothly change with respect to each other as indicated in FIG. 18 of the first embodiment, within a range of control of operation of the internal combustion engine. The cam nose of each three-dimensional cam may also be formed so as to achieve a relationship as indicated in FIG. 24 of the second embodiment, within a range of control of operation of the internal combustion engine.

Figure 34:
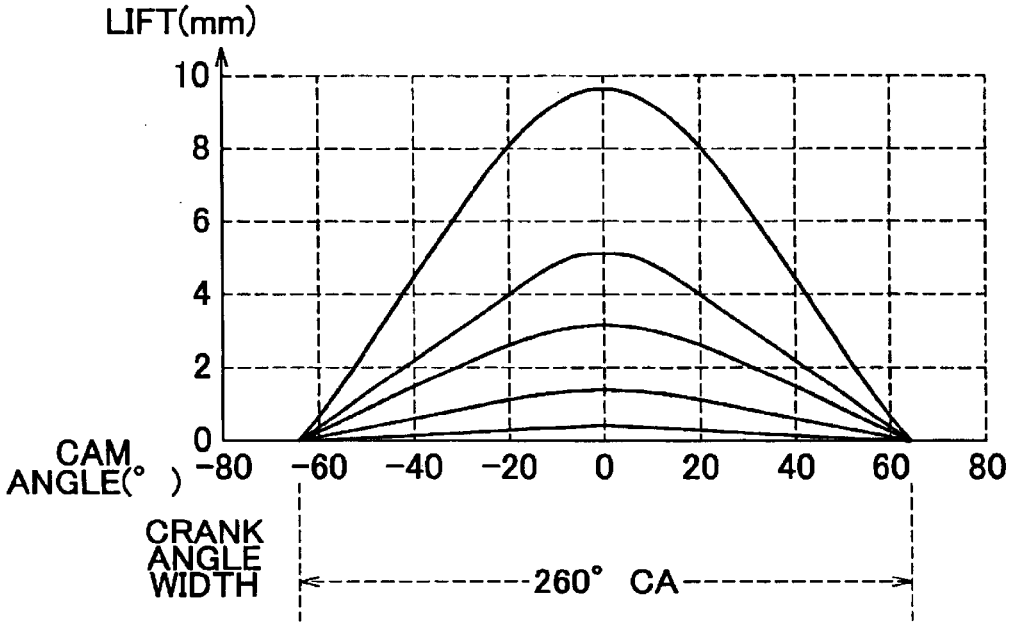
FIG. 34 is a diagram indicating changes in the valve operation angle in accordance with a further embodiment.

(c) Depending on the cam profile of the three-dimensional cams in the third embodiment, it is also possible to change the valve lift while maintaining a fixed valve operation angle as indicated in FIG. 34 through axial movement of the three-dimensional cams, in order to adjust the amount of intake air. In this case, too, the cam profile of the three-dimensional cams is designed so that the rate of change in the valve lift with respect to the amount of axial movement of the three-dimensional cams is smaller in a low-valve lift region than in a high-valve lift region. As a result, high-precision adjustment of the valve lift is achieved only in the low-valve lift region. Therefore, a size increase of the entire construction of the valve lift adjustment mechanism can be avoided, and the mechanism can easily be incorporated into an engine. Furthermore, the mechanism does not produce a problem in the operation control of the engine.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claim is:

1. A variable valve mechanism of an internal combustion engine capable of changing at least one of a valve operation angle and a valve lift, comprising:

a valve lift adjustment mechanism that adjusts the at least one of a valve operation angle and a valve lift with a higher precision in a region where the at least one of a valve operation angle and a valve lift is relatively small than in a region where the at least one of a valve operation angle and a valve lift is relatively large, wherein the valve operation angle is a region where the valve is opened, wherein the valve lift adjustment mechanism comprises:

a control member; and a controller that adjusts the at least one of a valve operation angle and a valve lift by actuation of the control member, and that converts the actuation of the control member into a change in the at least one of a valve operation angle and a valve lift, and that achieves a smaller rate of conversion of an amount of actuation of the control member into an amount of change in the at least one of a valve operation angle and a valve lift in the region where the at least one of a valve operation angle and a valve lift is relatively small than in the region where the at least one of a valve operation angle and a valve lift is relatively large, wherein the controller comprises a cam provided on a camshaft that rotates in association with rotation of the internal combustion engine, and an intervening actuation mechanism having an input portion and an output portion which is pivotably supported by a shaft different from the camshaft and which actuates a valve via the output portion when the input portion is actuated by the cam, and wherein the control member is a control shaft whose amount of movement in a direction of an axis is associated with a relative phase difference between the input portion and the output portion of the intervening actuation mechanism, and wherein the controller adjusts the relative phase difference between the input portion and the output portion of the intervening actuation mechanism by moving the control shaft in the direction of the axis, and therefore adjusts the at least one of a valve operation angle and a valve lift.

2. The variable valve mechanism of the internal combustion engine according to claim 1, wherein the at least one of a valve operation angle and a valve lift is within a range that allows operation of the internal combustion engine.

3. The variable valve mechanism of the internal combustion engine according to claim 1, wherein the valve lift adjustment mechanism adjusts the at least one of a valve operation angle and a valve lift with a higher precision in the region where the at least one of a valve operation angle and a valve lift is relatively small than in the region where the at least one of a valve operation angle and a valve lift is relatively large, by bringing about a non-linear relationship between the at least one of a valve operation angle and a valve lift and an amount of adjustment in the at least one of a valve operation angle and a valve lift.

4. The variable valve mechanism of the internal combustion engine according to claim 1, wherein the intervening actuation mechanism achieves a smaller rate of conversion from the amount of movement of the control shaft in the direction of the axis into an amount of change in the relative phase difference between the input portion and the output portion in the region where the at least one of a valve operation angle and a valve lift is relatively small than in the region where the at least one of a valve operation angle and a valve lift is relatively large, and therefore achieves a smaller rate of conversion from the amount of movement of the control shaft in the direction of the axis into the amount of change in the at least one of a valve operation angle and a valve lift in the region where the at least one of a valve operation angle and a valve lift is relatively small than in the region where the at least one of a valve operation angle and a valve lift is relatively large.

5. The variable valve mechanism of the internal combustion engine according to claim 4, wherein the intervening actuation mechanism achieves a smaller rate of conversion from the amount of movement of the control shaft in the direction of the axis into the amount of change in the relative phase difference between the input portion and the output portion in the region where the at least one of a valve operation angle and a valve lift is relatively small than in the region where the at least one of a valve operation angle and a valve lift is relatively large, via a construction in which the relative phase difference between the input portion and the output portion is adjusted by a spline mechanism portion that functions in association with the movement of the control shaft in the direction of the axis and in which an angle of inclination of a spline formed in the spline mechanism portion changes with respect to the direction of the axis.

6. The variable valve mechanism of the internal combustion engine according to claim 1, wherein the cam has such a profile that a portion of the cam that is relatively near to a cain nose distal end portion but not in the cam nose distal end portion produces a greater change in an amount of actuation of the input portion during rotation of the cam than a portion of the cam that is relatively remote from the cam nose distal end portion, and therefore the rate of conversion from the amount of movement of the control shaft in the direction of the axis into the amount of change in the at least one of a valve operation angle and a valve lift is made smaller in the region where the at least one of valve operation angle and a valve lift is relatively small than in the region where the at least one of a valve operation angle and a valve lift is relatively large.

7. The variable valve mechanism of the internal combustion engine according to claim 1, wherein the valve lift adjustment mechanism changes the at least one of a valve operation angle and a valve lift by moving, in a direction of an axis, a three-dimensional cam whose cam profile changes in the direction of the axis, and the cam profile of the three-dimensional cam changing in the direction of the axis allows the at least one of a valve operation angle and a valve lift to be adjusted with a higher precision in the region where the at least one of a valve operation angle and a valve lift is relatively small than in the region where the at least one of a valve operation angle and a valve lift is relatively large.

8. The variable valve mechanism of the internal combustion engine according to claim 7, wherein the cam profile of the three-dimensional cam achieves a smaller rate of change in the at least one of a valve operation angle and a valve lift with respect to an amount of movement of the three-dimensional cam in the direction of the axis in the region where the at least one of a valve operation angle and a valve lift s relatively small than in the region where the at least one of a valve operation angle and a valve lift is relatively large.

9. The variable valve mechanism of the internal combustion engine according to claim 1, wherein an object where the at least one of a valve operation angle and a valve lift is changed is an intake valve of the internal combustion engine.

10. An intake air amount control apparatus of an internal combustion engine, comprising:

a variable valve mechanism described in claim 1 and provided for an intake valve of the internal combustion engine; and an air amount controller that adjusts an amount of intake air by adjusting the at least one of a valve operation angle and a valve lift of the intake valve via the variable valve mechanism.

11. A variable valve mechanism of an internal combustion engine capable of changing at least one of a valve operation angle and a valve lift, comprising:

a valve lift adjustment mechanism that adjusts the at least one of a valve operation angle and a valve lift with a higher precision in a region where the at least one of a valve operation angle and a valve lift is relatively small than in a region where the at least one of a valve operation angle and a valve lift is relatively large, wherein the valve operation angle is a region where the valve is opened, wherein the valve lift adjustment mechanism comprises:

a control member;

control member actuation means for adjusting the at least one of a valve operation angle and a valve lift by actuating the control member; and valve lift conversion means for achieving a smaller rate of conversion from an amount of actuation of the control member into an amount of change in the at least one of a valve operation angle and a valve lift in the region where the at least one of a valve operation angle and a valve lift is relatively small than in the region where the at least one of a valve operation angle and a valve lift is relatively large, wherein the valve lift conversion means comprises a cam provided on a camshaft that rotates in association with rotation of the internal combustion engine,and an intervening actuation mechanism having an input portion and an output portion which is pivotably supported by a shaft different from the camshaft and which actuates a valve via the output portion when the input portion is actuated by the cam, and wherein the control member is a control shaft whose amount of movement in a direction of an axis is associated with a relative phase difference between the input portion and the output portion of the intervening actuation mechanism, and wherein the control member actuation means adjusts the relative phase difference between the input and the output portion of the intervening actuation mechanism by moving the control shaft in the direction of the axis, and therefore adjusts the at least one of a valve operation angle an a valve lift.

12. The variable valve mechanism of the internal combustion engine according to claim 11, wherein the intervening actuation mechanism achieves a smaller rate of conversion from the amount of movement of the control shaft in the direction of the axis into an amount of change in the relative phase difference between the input portion and the output portion in the region where the at least one of a valve operation angle and a valve lift is relatively small than in the region where the at least one of a valve operation angle and a valve lift is relatively large, and therefore achieves a smaller rate of conversion from the amount of movement of the control shaft in the direction of the axis into the amount of change in the at least one of a valve operation angle and a valve lift in the region where the at least one of a valve operation angle and a valve lift is relatively small than in the region where the at least one of a valve operation angle and a valve lift is relatively large.

13. The variable valve mechanism of the internal combustion engine according to claim 12, wherein the intervening actuation mechanism achieves a smaller rate of conversion from the amount of movement of the control shaft in the direction of the axis into the amount of change in the relative phase difference between the input portion and the output portion in the region where the at least one of a valve operation angle and a valve lift is relatively small than in the region where the at least one of a valve operation angle and a valve lift is relatively large, via a construction in which the relative phase difference between the input portion and the output portion is adjusted by a spline mechanism portion that functions in association with the movement of the control shaft in the direction of the axis and in which an angle of inclination of a spline formed in the spline mechanism portion changes with respect to the direction of the axis.

14. The variable valve mechanism of the internal combustion engine according to claim 11, wherein the cam has such a profile that a portion of the cam that is relatively near to a cam nose distal end portion but not in the cam nose distal end portion produces a greater change in an amount of actuation of the input portion during rotation of the cam than a portion of the cam that is relatively remote from the cam nose distal end portion, and therefore the rate of conversion from the amount of movement of the control shaft in the direction of the axis into the amount of change in the at least one of a valve operation angle and a valve lift is made smaller in the region where the at least one of a valve operation angle and a valve lift is relatively small than in the region where the at least one of a valve operation angle and a valve lift is relatively large.

* * * * *

UNITED STATES PATENT AND TRADEMARK OFFICE

CERTIFICATE OF CORRECTION

PATENT NO. : 6,951,195 B2
DATED : October 4, 2005
INVENTOR(S) : Shuuji Nakano et al.

It is certified that error appears in the above-identified patent and that said Letters Patent is hereby corrected as shown below:

Column 2,
Line 14, after “consisting” delete “,”.

Column 17,
Line 31, change “What is claim is:” to -- What is claimed is: --.

Column 19,
Line 3, before “valve” insert -- a --.
Line 25, change “lift s” to -- lift is --.

Signed and Sealed this

Twenty-fourth Day of January, 2006

JON W. DUDAS
*Director of the United States Patent and Trademark Office*